US008845025B2

(12) United States Patent
Kurata et al.

(10) Patent No.: US 8,845,025 B2
(45) Date of Patent: Sep. 30, 2014

(54) LUMBAR SUPPORT DEVICE FOR CHAIR

(75) Inventors: Fumihiro Kurata, Nagano (JP); Isao Okamoto, Nagano (JP)

(73) Assignee: Takano Co., Ltd., Nagano (JP)

( * ) Notice: Subject to any disclaimer, the term of this patent is extended or adjusted under 35 U.S.C. 154(b) by 2 days.

(21) Appl. No.: 13/634,008

(22) PCT Filed: Sep. 2, 2010

(86) PCT No.: PCT/JP2010/005411

§ 371 (c)(1),
(2), (4) Date: Sep. 11, 2012

(87) PCT Pub. No.: WO2011/117937

PCT Pub. Date: Sep. 29, 2011

(65) Prior Publication Data

US 2013/0001993 A1 Jan. 3, 2013

(30) Foreign Application Priority Data

Mar. 24, 2010 (JP) ..... PCT/JP2010/002066

(51) Int. Cl.
*A47C 3/00* (2006.01)
*A47C 7/46* (2006.01)
*A47C 7/48* (2006.01)

(52) U.S. Cl.
CPC .. *A47C 7/462* (2013.01); *A47C 7/48* (2013.01)
USPC ..... 297/284.4; 297/284.1; 297/284.9; 297/284.3

(58) Field of Classification Search
USPC ..... 297/123, 284.4, 284.6, 284.9, 284.3, 297/284.1
See application file for complete search history.

(56) References Cited

U.S. PATENT DOCUMENTS 4,161,337 A * 7/1979 Ross et al. ..... 297/230.12
5,076,643 A * 12/1991 Colasanti et al. ..... 297/284.6

(Continued)

FOREIGN PATENT DOCUMENTS

EP 1234529 A1 8/2002
EP 1676745 A1 7/2006

(Continued)

*Primary Examiner* — Chi Q Nguyen
(74) *Attorney, Agent, or Firm* — Notaro, Michalos & Zaccaria P.C.

(57) ABSTRACT

In order to provide a lumbar support apparatus whose position can be adjusted by a simple structure and which can softly support a lumbar vertebra portion of a sitting person, a lumbar support apparatus of a chair according to the present invention is configured by two lumbar support members 10 which are separated into left and right parts, each of the lumbar support members 10 includes a lumbar support portion 11 supporting the lumbar vertebra portion and a stay portion 12 supporting the lumbar support portion, and an end portion of the lumbar support stay portion 12 is rotatably connected and attached to a back frame 2 via a rotation shaft 14, so that the position of the lumbar support portion 11 in the height direction can be adjusted by moving the same such that its distal end side is moved in a circular manner about the rotation shaft 14.

14 Claims, 20 Drawing Sheets

(56) References Cited

U.S. PATENT DOCUMENTS

| | | | | |
|---|---|---|---|---|
| 5,558,398 | A * | 9/1996 | Santos | 297/284.3 |
| 7,347,495 | B2 * | 3/2008 | Beyer et al. | 297/284.3 |
| 7,393,054 | B2 * | 7/2008 | McQueen et al. | 297/284.4 |
| 7,517,024 | B2 * | 4/2009 | Cvek | 297/452.13 |
| 7,806,478 | B1 * | 10/2010 | Cvek | 297/300.1 |
| 8,251,454 | B2 * | 8/2012 | Tsukiji et al. | 297/452.18 |
| 2003/0137173 | A1 | 7/2003 | Kinoshita et al. | |
| 2004/0174056 | A1 * | 9/2004 | Gryp et al. | 297/284.6 |
| 2005/0062323 | A1 * | 3/2005 | Dicks | 297/284.4 |
| 2006/0138832 | A1 | 6/2006 | Ogura | |
| 2009/0236890 | A1 * | 9/2009 | Kan et al. | 297/297 |

FOREIGN PATENT DOCUMENTS

| | | | |
|---|---|---|---|
| JP | 07-265169 | A | 10/1995 |
| JP | 2002-119375 | A1 | 4/2002 |
| JP | 2007-130352 | A | 11/2005 |
| JP | 2006-204884 | A | 8/2006 |
| JP | 2006-263096 | | 10/2006 |
| JP | 2007-130352 | A | 5/2007 |
| JP | 2007190219 | | 8/2007 |

* cited by examiner

Fig. 27
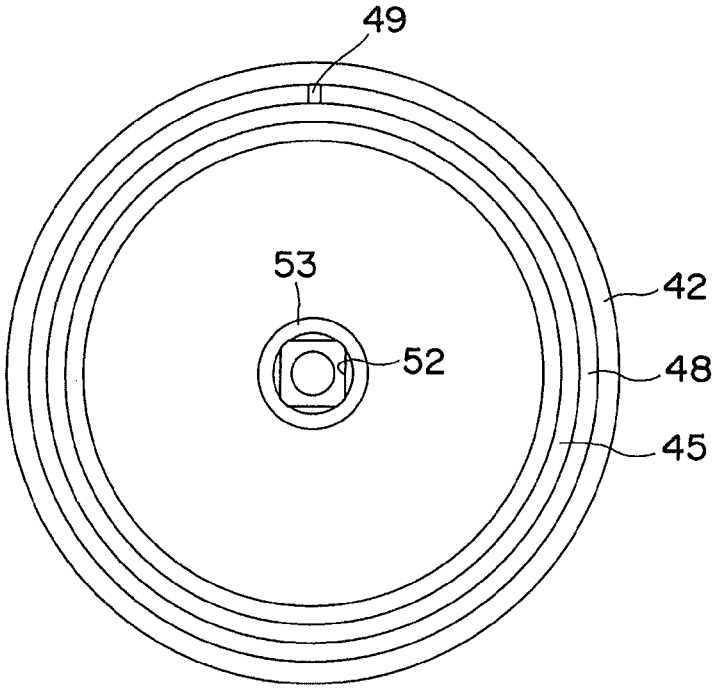
Fig. 28
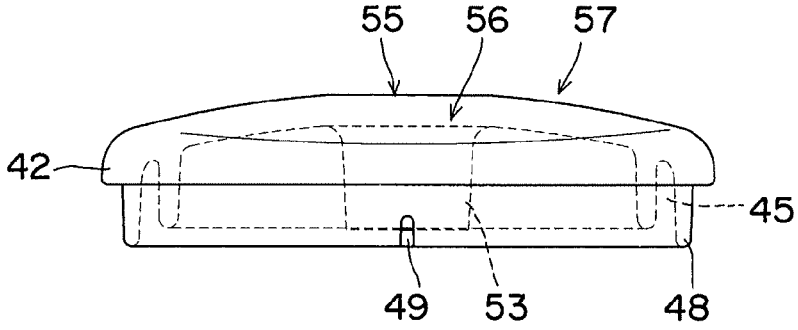
Fgi. 29
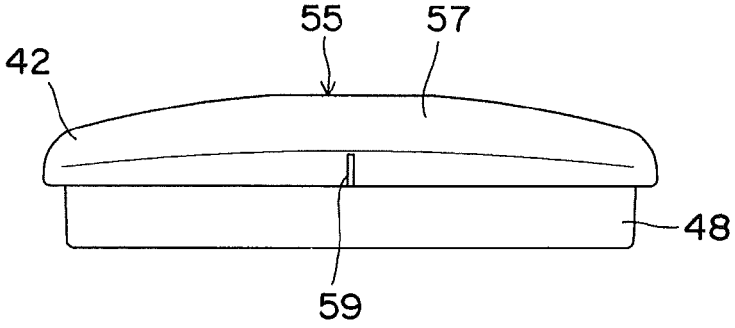

LUMBAR SUPPORT DEVICE FOR CHAIR

TECHNICAL FIELD

The present invention relates to a lumbar support apparatus which supports a lumbar vertebra portion of a person sitting on a chair. More specifically, the present invention relates to a cantilever-type lumbar support apparatus of a chair which can support a lumbar portion of a sitting person at its left and right parts, respectively.

BACKGROUND ART

Conventionally, there is a chair provided with a lumbar support apparatus which effectively supports a lumbar portion of a sitting person. Moreover, there is a lumbar support apparatus having a structure which can be fitted with a physique of a sitting person by moving upward and downward a lumbar support member for supporting a lumbar portion (Patent Literature 1). In this lumbar support apparatus, a lumbar portion of a sitting person is supported by a lumbar support main body disposed at the center of a backrest by a support belt which is bridged so as to cross a backrest frame. The support belt is provided at its both ends protrusions which are fitted into holes formed in left and right vertical frame portions of the backrest frame. The lumbar support main body and the support belt supporting the same can be moved in upward and downward directions by shifting the positions of the holes, into which the protrusions are fitted, in the upward and downward directions. The both ends of the support belt supporting the lumbar support main body are sandwiched from their front and rear sides by a cover material and a back frame, and an upward and downward slide structure having a simple structure is formed by the protrusions and the holes between the support belt and the back frame.

Moreover, there is proposed a lumbar support apparatus supporting a lumbar portion by a lumbar support member which is separated into left and right parts (Patent Literature 2). This lumbar support apparatus has a lumbar plate supporting a lumbar vertebra of a sitting person, and the lumbar plate is preliminary divided into two pieces, i.e., a right half plate and a left half plate. Both plates are independently and elastically supported on a support shaft which is rotatably installed on a seat back frame via left and right support arms configured by torsion springs. The left and right support arms configured by the torsion springs are supported by the support shaft, and each of the plates is rotatably disposed on a free end thereof which is bent in a L-shape toward an inside of the back frame. Both ends of the support shaft are fixedly provided with lock plates on which proximal ends of the left and right support arms are locked. By swinging one of the lock plates by a cam which is rotated by an operation knob, the support shaft is rotated so that a restoring force is applied toward a seat direction of the seat back via the torsion spring to each of the lumbar plates at the free ends of the support arm.

CITATION LIST

Patent Literature

Patent Literature 1: Japanese Patent Application Laid-Open No. 2007-190219

Patent Literature 2: Japanese Patent Application Laid-Open No. H07-265169

SUMMARY OF INVENTION

Technical Problem

However, the lumbar support apparatus of Patent Literature 1 has a structure in which the lumbar support main body disposed at the center of the backrest is attached to the left and right vertical frame portions of the back frame by the support belts at both ends, so that the deflection amount of the lumbar support member in the backward direction when a sitting person leans on the backrest surface is restricted by the length of the support belt. As a result, the force supporting the lumbar vertebra of the sitting person tends to be stronger at the center of the backrest than other portions thereof. Specifically, when the backrest surface is configured by only a cover material like mesh, the support for the lumbar vertebra portion by the lumbar support main body becomes prominent, so that the sitting person may feel uncomfortable by being pressed by a strong pressure on the backbone in the case that a rigid material is used for making the lumbar support main body.

Moreover, a cantilevered structure such as that disclosed in Patent Literature 2 requires a complicated structure having a lot of parts, so that the cost increases and the space required for its installation cannot be minimized. Furthermore, when the backrest surface is configured by only a cover material like mesh which is covered on the back frame, the complicated structure of the lumbar support apparatus is exposed on the back side of the backrest, so that the appearance of the backrest of the chair may be deteriorated. Additionally, the lumbar support apparatus of Patent Literature 2 further requires a slide mechanism for coordinately moving both ends of the support shaft upward and downward in order that the lumbar plate is moved upward and downward. As a result, the lifting mechanism becomes complicated and large-scaled, thereby further raising the cost and increasing the size. Moreover, when the lumbar support apparatus supported by only a single support shaft is moved upward and downward by means of the slide mechanism using a groove, its movement cannot be smooth so that it is difficult to smoothly move the lumbar support apparatus while being precisely positioned. Additionally, a sufficient rigidity cannot be obtained by the support via the slide mechanism so that its strength may be insufficient.

The present invention has an object to provide a lumbar support apparatus of a chair which can elastically and softly support a lumbar vertebra portion of a sitting person. Moreover, the present invention has an object to provide a lumbar support apparatus of a chair whose height can be adjusted by a simple structure.

Solution to Problem

In order to achieve the above-mentioned objects, a lumbar support apparatus of a chair according to the present invention is configured by two lumbar support members which are separated into left and right parts. Each of the lumbar support members includes a lumbar support portion supporting a lumbar vertebra portion and a stay portion supporting the lumbar support portion. An end portion of the lumbar support stay portion is rotatably connected and attached to a back frame via a rotation shaft, so that the position of the lumbar support portion can be adjusted by moving the same such that its distal end side is moved in a circular manner about the rotation shaft.

Here, the lumbar support portion and the lumbar support stay portion are configured by separate members, and these portions are preferred to be connected with each other by being fitted into a sheath portion which is disposed at one of the lumbar support portion and the lumbar support stay portion. Moreover, the lumbar support portion and the lumbar support stay portion are preferred to be connected with each other so as to be slidable in the longitudinal directions of the lumbar support stay portion. Of course, the lumbar support portion and the lumbar support stay portion can be configured by an integrally molded part.

In the lumbar support apparatus of the present invention, a positioning mechanism is preferred to be disposed between the back frame and the lumbar support member. For example, it is preferred that an uneven portion is formed on one of the lumbar support stay portion and the back frame, and the other of the same is provided with an elastic member which is fitted into the uneven portion, so that an appropriate resistance (in other words, an intermittency resistance) is applied to the rotation of the lumbar support stay portion. Note that, although the uneven portion and the elastic member can be disposed on the lumbar support stay portion or a face or an edge of the back frame opposite thereto, it is more preferable that the uneven portion and the elastic member are disposed at a circumferential edge portion of the lumbar support stay portion, which causes less changes of the fastening force of the lumbar support stay portion, and a face opposite thereto.

In the lumbar support apparatus of the present invention, at least the opposing faces of the lumbar support portions disposed on the left and right sides are preferred to form arc surfaces or ellipsoids.

In the lumbar support apparatus of the present invention, the lumbar support portion is preferably provided with a convex portion which projects toward the front side.

In the lumbar support apparatus of the present invention, the lumbar support stay portion is disposed in a direction orthogonal to the rotation shaft which is disposed in the forth and back directions of the backrest with respect to the back frame. The lumbar support portion is disposed so as to be inclined with respect to the lumbar support stay portion, and is disposed parallel to the portion of the cover material opposite to the lumbar support portion.

In the lumbar support apparatus of the present invention, the left and right lumbar support portions are preferably linked with each other so that the lumbar support stay portion is coordinately rotated about the rotation shaft. For example, an oblong hole is formed at one of the left and right lumbar support portions, and a connection pin is provided at the other of the left and right lumbar support portions so as to pass through the oblong hole. Preferably, the left and right lumbar support portions are linked with each other in the rotation directions about the rotation shaft, and are slidable in the width directions of the backrest, and are connected with a play in the forth and back directions of the backrest. Preferably, the left and right lumbar support portions are rotatably connected via a link with each other, and the lumbar support portion and the lumbar support stay portion are configured by separate members, and besides, one of the lumbar support portion and the lumbar support stay portion is provided with a sheath portion into which the other member is slidably fitted so as to be connected thereto. Moreover, gears are formed on the arc surfaces inside the lumbar support portions where the lumbar support portions disposed on the left and right sides are opposite to each other. Preferably, these gears are meshed with each other so that the lumbar support portions are moved in the forth and back directions of the backrest independently with each other so as to be a non-linkage relationship, and are coordinately rotated in the swinging directions by the meshing of the gears.

In the lumbar support apparatus of the present invention, the lumbar support portions, which are separated into two parts, may be extended over the center of the backrest so that the distal end side of the lumbar support portion protrudes toward the other lumbar support member side.

Moreover, in the lumbar support apparatus of the present invention, the face of the lumbar support portion supporting the body of the sitting person preferably includes a plurality of support regions by which different strengths for the body of the sitting person can be obtained. Here, the plurality of support regions are preferably configured by, for example, forming a primary abutment surface which is abutted against the body of the sitting person relatively strongly because the projecting amount thereof toward the body of the sitting person is large, and a secondary abutment surface which is abutted against the body of the sitting person relatively weakly because the projecting amount thereof is smaller than that of the primary abutment surface. In this case, the secondary abutment surface is preferably a flank including an inclination which is apart from the cover material or follows the same. The plurality of the support regions may be formed by differently setting the strengths of the surfaces thereof, and there may be formed by using the difference of the strengths the primary abutment surface which is rigid so as to be abutted against the body of the sitting person relatively strongly, and the secondary abutment surface which is softer than the primary abutment surface so as to be abutted against the body of the sitting person relatively weakly. Moreover, the lumbar support portion may be configured by a pad which has a plurality of support regions and a base which is formed as a separate body separable from the pad so as to be supported by the lumbar support stay portion. The plurality of support regions, by which different abutment strengths against the body of the sitting person can be obtained, may be configured such that the plurality of support regions can be changed into various modes by the pad which is configured to be replaceable. The position of the primary abutment surface may be made changeable by making the assembling position of the pad and the base supporting the pad changeable so that the assembling angle of the pad can be changed.

The lumbar support portion is preferably configured such that a rotation shaft, on which the lumbar support portion is disposed so as to be rotatable with respect to the lumbar support stay portion, is disposed between the plurality of support regions, so that the positions where the plurality of support regions are abutted against the body can be changed by the rotation about the rotation shaft.

For example, the lumbar support portion is preferably supported so as to be rotatable with respect to the lumbar support stay portion about the rotation shaft which is disposed in the forth and back directions of the backrest, so that the position of the primary abutment surface can be changed by the rotation of the lumbar support portion. Moreover, the lumbar support portion is preferred to be configured by a pad which includes a plurality of support regions and a base which is formed by a separate body separable from the pad so as to support the pad and is supported by the lumbar support stay portion. The pad is preferably made rotatable by using the connection shaft, which connects the pad with the base at their centers, as a shaft in the forth and back directions of the backrest, so that the position of the primary abutment surface can be changed by the rotation of the pad.

The lumbar support portion can be rotated with respect to the lumbar support stay portion about the shaft which is disposed in the upward and downward directions or width directions of the backrest, or an inclined direction therebetween. In this case, the surface shapes of the lumbar support portion are preferably made different between the front side of the body side surface for the sitting person of the lumbar support portion and the rear side of its opposite side surface while the rotation shaft is positioned at the midpoint. With this, the rear side and the front side can be changed with each other by rotating the lumbar support portion about the rotation shaft, so that the abutting strength of the lumbar support portion or the position where the lumbar support portion is strongly abutted against the body can be adjusted. Moreover, the projecting amount toward the backrest or the stiffness is changed between the front side of the body side surface for the sitting person of the lumbar support portion and the rear side of its opposite side surface while the rotation shaft is positioned at the midpoint. With this, the abutting strength of the lumbar support portion against the body can be adjusted by changing the rear side and the front side with each other by rotating the lumbar support portion about the rotation shaft.

The structure for changing the position where the lumbar support portion is abutted against the body is not limited to the structure in which the lumbar support portion itself is rotated, thereby changing the front side of the body side surface for the sitting person and the rear side of its opposite side surface with each other. For example, the lumbar support portion may be provided with a pad supporting the body of the sitting person so as to be linearly movable along the surface of the base supported by the lumbar support stay portion, and the projecting position or the projecting amount can be changed by the linear movement of the pad on the base.

Advantageous Effects of Invention

According to the lumbar support apparatus for a chair of the present invention, the lumbar portion of the sitting person is cantilevered by the two lumbar support members which are separated into left and right parts, so that the deflection amount can be ensured by adopting a structure in which the left and right lumbar support portions can be independently deflected in the backward direction of the chair. Accordingly, the lumbar portion of the sitting person can be softly received and elastically supported. Moreover, according to this structure, by the elastic support for the lumbar vertebra of the sitting person by the independent left and right lumbar support members, the lumbar vertebra supporting force from the lumbar plate follows the movement of the load in the left and right directions. Therefore, the sufficient support can be stably obtained for the lumbar vertebra portion, even when the body is twisted.

According to the lumbar support apparatus of the present invention, the structure is simple such that the lumbar support member including the lumbar support portion and the lumbar support stay portion is rotatably attached to the back frame, and the position in the upward and downward directions can be adjusted by the rotation movement. Accordingly, the number of the required parts can be minimized, the structure can be made compact, and the cost can be lowered.

According to the lumbar support apparatus of the present invention, because the height adjustment of the lumbar support portion can be performed by the rotation movement of the lumbar support member, so that the lifting operation of the lumbar support portion can be performed smoothly.

Moreover, the lumbar portion can be supported by the lumbar support portions of two members which are separated into the left and right parts with the backbone of the sitting person being avoided, so that the uncomfortable feeling due to the direct abutment of the lumbar support portion against the backbone can be minimized. Even if the backbone is abutted against the lumbar support portion, the force applied to the backbone can be weakened by the deflection of the lumbar support member itself, thereby minimizing the uncomfortable feeling. According to the lumbar support apparatus of the present invention, the left and right parts of the lumbar support portions can be moved separately because the lumbar support portions are separated, so that the lumbar portion support can be performed according to the demands of the sitting person.

According to the lumbar support apparatus of the present invention, the left and right lumbar support portions can be moved independently with each other, so that the left and right lumbar support portions can be moved in the opposite directions to each other, be positioned at the different heights from each other, and the lumbar vertebra portion can be supported at the different heights between the left and right parts. With this, even when the posture of the sitting person is inclined, or the sitting person tends to sit in an inclined posture, the left and right lumbar support member can be independently positioned at suitable heights, so that the lumbar vertebra portion of the sitting person can be suitably supported.

In the lumbar support apparatus of the present invention, the lumbar support portion and the lumbar support stay portion are configured by separate members, and are connected with each other by fitting the same into the sheath portion which is disposed at one of the lumbar support portion and the lumbar support stay portion. Accordingly, the lumbar support portion and the lumbar support stay portion can be made by different materials, so that the lumbar support stay portion requiring a rigidity can be made by a highly rigid material, and the lumbar support portion requiring a softness can be made by a soft material. Therefore, the softness and the rigidity can be simultaneously achieved so that the strength of the lumbar support member can be ensured without any anxiety. Moreover, in the present invention, when the lumbar support portion is connected to the lumbar support stay portion slidably in the longitudinal directions, the position where the lumbar vertebra is supported by the lumbar support portion can be moved also in the transverse directions according to the need. This means that the space between the left and right lumbar support portions can be adjusted, and the left and right lumbar support portions can be moved in the left and right directions while maintaining the space therebetween. Therefore, finer adjustments can be performed according to the feeling and the bodily features which are specific to the sitting person.

In the lumbar support apparatus of the present invention, when the positioning mechanism is disposed between the back frame and the lumbar support member, the lumbar support member can be surely fixed at a predetermined position or any position. Above all, when the uneven portion is formed at one of the lumbar support stay portion and the back frame, and the elastic member fitted into the uneven portion is disposed at the other, so as to provide an appropriate resistance to the rotation of the lumbar support stay portion, the fact that the lumbar support member is settled in the fixed position can be easily confirmed by the click feeling. Of course, the positioning mechanism is not limited the combination of the uneven portion and the elastic member fitted thereto, and even when the positioning of the lumbar support member is performed by increasing the friction between the lumbar support stay portion and the back frame, it is needless to say that the same effect can be obtained in terms of preventing the lumbar support member from sliding down due to its self-weight.

In the lumbar support apparatus of the present invention, when at least the opposing faces of the lumbar support portions disposed on the left and right sides are formed to have arc surfaces or ellipsoids, the left and right lumbar support portions do not interfere with each other by their arc movements. Therefore, when the space between the lumbar support portions disposed on the left and right sides needs to be decreased, the space can be decreased to the minimum value.

In the lumbar support apparatus of the present invention, when the convex portion projecting toward the front side is disposed at the lumbar support portion, the lumbar vertebra portion of the sitting person can be supported at the positions which are surely separated on the left and right sides from the center line of the backrest. Accordingly, even when the sitting posture of the sitting person is deviated from the center line of the backrest, it is few that the backbone is directly pressed.

In the lumbar support apparatus of the present invention, when the lumbar support portion is disposed so as to be inclined with respect to the lumbar support stay portion, and is disposed parallel to the portion of the cover material opposite to the lumbar support portion, the lumbar support portion is rotated substantially parallel to the cover material. Accordingly, even when the lumbar support stay portion is rotated so as to adjust its position in the height direction, the distance between the lumbar support stay portion and the cover material is not changed, so that the change of the force which supports the lumbar vertebra portion is small. The lumbar support stay portion or the lumbar support portion is not necessarily disposed strictly parallel to the portion of the cover material opposite thereto, and can be disposed substantially parallel to thereto.

In the lumbar support apparatus of the present invention, when the left and right lumbar support portions are linked with each other so that the lumbar support stay portion is coordinately rotated, the left and right lumbar support portions and the stay portions can be simultaneously moved by the same amounts by grasping one of the lumbar support members so as to move the same upward or downward, so that the height adjustment of the lumbar support portion can be easily performed. Moreover, although the left and right lumbar support members are linked in only the rotation directions, they can be independently deflected in the backward direction of the chair, so that the lumbar portion of the sitting person can be softly received and elastically supported.

Moreover, when the left and right lumbar support members are linked with each other in swinging directions, and are connected by the oblong hole and the connection pin passing through the oblong hole, such that they can be slidable in the horizontal directions, and the play is kept in the forth and back directions of the chair, the space between the left and right lumbar support portions is not changed even when the positions of the lumbar support portions in the height direction is changed, so that the lumbar vertebra portion of the sitting person can be supported at the same positions regardless of its height.

When the lumbar support portion is connected with the lumbar support stay portion slidable in the longitudinal directions, and the left and right lumbar support portions are rotatably connected with each other via the link, the space between the left and right lumbar support portions is not changed even when the position of the lumbar support portion in the height direction is changed, so that the lumbar vertebra portion can be supported at the same position thereof in the width directions, regardless of the height of the lumbar support portion which is changed.

When the left and right lumbar support members are coordinately rotated with each other by meshing the gears thereof with each other, the rotation movement of one of the lumbar support portions can be smoothly transmitted to the other of the lumbar support portions, so that the left and right lumbar support portions can be easily moved upward and downward.

In the lumbar support apparatus of the present invention, even when the lumbar support portions which are separated into two parts are configured such that the distal end side of the lumbar support portion protrudes beyond the center of the backrest, the lumbar vertebra portion is supported at mainly the area of the back adjacent to the backbone. However, in any case, the lumbar vertebra portion is supported by the lumbar support members which are separated from each other and are cantilevered, so that the abutment against the lumbar vertebra portion of the sitting person can be made soft.

In the lumbar support apparatus of the present invention, when the face of the lumbar support portion supporting the body of the sitting person includes a plurality of support regions which can provide the different abutment strengths against the body of the sitting person, the face supporting the body can be made so as to include the portion which positively provides the strong abutment of the lumbar support portion, and the portion which does not function as the abutment surface for positively providing the strong abutment, but softly supports the cover material and the lumbar portion of the sitting person so as to follow the cover material. Accordingly, when the primary abutment surface and the secondary abutment surface exist in the same abutment surface, the lumbar vertebra portion of the sitting person is supported at the strongly abutted portion and the relatively softly supported portion, so that the uncomfortable feeling caused by the local pressing is minimized, while certainly feeling the sense that the body is pressed. Moreover, by changing the arrangement of the plurality of support regions at the position of the lumbar support portion, the position where the abutment against the body of the sitting person is relatively strong can be moved. In other words, the abutment strength at a given position of the body of the sitting person can be changed. Therefore, the position where the lumbar support portion is strongly abutted against the body can be widely and subtly changed, combined with the swinging motion of the entire lumbar support member about the rotation shaft.

Specifically, when the secondary abutment surface is formed by the flank including an inclination which is apart from the cover material or follows the same, even if the inclination θ is not provided to the lumbar support portion with respect to the lumbar support stay portion which is attached in the direction orthogonal to the rotation shaft of the back frame, by disposing the secondary abutment surface on the center side of the backrest, and disposing the primary abutment surface on its opposite side and closer to the rotation shaft of the back frame, the abutment surface is formed at the angle easily following the shape of the cover material, so that the operation for the angle adjustment can be omitted. Furthermore, even when the lumbar support member is rotated about the rotation shaft, the lumbar support portion is moved parallel to and along the cover material opposite thereto, so that the distance between the lumbar support portion and the cover material is not changed. Accordingly, the force supporting the lumbar vertebra portion of the sitting person is not changed. When the secondary abutment surface is disposed on the center side of the back frame, the portion of the backrest closer to the center is depressed such that the cover material follows the secondary abutment surface, so that the backbone portion is not strongly pressed, and the portions other than the backbone are strongly abutted. Moreover, according to the preference of the sitting person, the secondary abutment surface is disposed closer to the rotation shaft side of the back frame, and the primary abutment surface is disposed on the center side of the back frame, so that the portion closer to the backbone can be strongly pressed.

Moreover, by differently setting the stiffness of the surfaces of the plurality of support regions, the lumbar support portion forming the abutment surface can easily form by using the difference of the stiffness the primary abutment surface which is rigid and is relatively strongly abutted against the body of the sitting person, and the secondary abutment surface which is softer than the primary abutment surface and is relatively softly abutted against the body of the sitting person. Accordingly, the surface of the lumbar support portion is made closely contact with the cover material which is depressed toward the backward side of the backrest, so that the cover material is rarely damaged by the corner of the lumbar support portion and the like. Moreover, not only the change of the abutting strength, but also the change of the abutment feeling related to the change of the stiffness according to the material and the like can be made.

Moreover, the lumbar support portion is configured by the separable pad and the base, so that, by changing the pad, the mode of the plurality of support regions can be easily changed in various ways so as to provide the different abutment strengths to the body of the sitting person. For example, when there are prepared several kinds of pads in which the distribution modes of the primary abutment surface and the secondary abutment surface, the numbers, shapes, and degrees of projecting amount of the primary abutment surface and the secondary abutment surface, are different from one another, the pad to be used can be suitably changed according to the preference of the sitting person, or the physical condition of the day or the situation of the pain in the lumbar portion of the sitting person.

Moreover, when the lumbar support portion is configured by the separable pad and the base so that the assembling position of the pad with respect to the base can be changed, the position of the primary abutment surface can be easily changed by changing the assembling angle of the pad. Accordingly, even when the pad itself is fixed during its use, the lumbar support portion can be preliminary set at a position according to the preference of the sitting person, so that the lumbar support portion can be strongly abutted against the more preferable position, combined with the swinging motion of the entire lumbar support member about the rotation shaft.

When the lumbar support portion is configured so as to be rotatable with respect to the lumbar support stay portion about the rotation shaft which is disposed among the plurality of support regions, so that the abutment positions of the plurality of the support regions for the body can be changed by the rotation of the lumbar support portion about the rotation shaft, only by the rotation of the lumbar support portion about the rotation shaft, without the rotation of the lumbar support stay portion about the rotation shaft, the position where the abutment for the body of the sitting person is relatively strong can be changed. In other words, the abutment strength at a given point of the body of the sitting person can be changed. Of course, by the combination with the rotation of the lumbar support member about the rotation shaft, the movement of the abutment position and the adjustment of the abutment strength can be made more precisely.

The lumbar support portion in the present invention is disposed so as to be rotatable with respect to the lumbar support stay portion about the rotation shaft which is disposed among the plurality of support regions capable of providing different abutment strengths, so that the abutment strength at a give point of the body of the sitting person and the region where the abutment is strong can be easily changed by the rotation of the lumbar support portion. Moreover, the changes can be made over the wide range, combined with the swinging motion of the entire lumbar support member about the rotation shaft.

When the lumbar support portion is configured to be separable into the pad including the plurality of support regions and the base supported by the lumbar support stay portion, and the pad is made to be rotatable about the shaft which is the connection shaft connecting the pad and the base with each other at their centers in the forth and back directions of the backrest, the position of the primary abutment surface in the height direction and the width direction of the backrest can be changed only by the rotation of the pad, the position where the lumbar support portion is strongly abutted against the body can be subtly changed over the wide range, combined with the swinging motion of the entire lumbar support member about the rotation shaft.

In the present invention, when the lumbar support portion is disposed so as to be rotatable with respect to the lumbar support stay portion about the shaft which is disposed in the upward and downward directions or the width directions of the backrest, or the inclined directions therebetween, the face opposing the cover material for supporting the body of the sitting person can be changed only by the rotation of the lumbar support portion. Accordingly, the abutment strength for the body and the strongly abutting position for the body by the lumbar support portion capable of having optional surfaces of different shapes or stiffness can be easily changed.

For example, when the surface shapes of the lumbar support portion are made different between the front side of the body side surface for the sitting person of the lumbar support portion and the rear side of its opposite side surface, only by switching the rear side and the front side by the rotation of the lumbar support portion, the abutment strength for the body and the strongly abutting position for the body by the lumbar support portion can be changed. Moreover, combined with the swinging motion of the entire lumbar support member about the rotation shaft, respective support regions have the movement loci which are different from each other between the front side and the rear side of the lumbar support portion, so that the abutment position and strength for the body can be changed over the wide range.

When the lumbar support portion is provided with a surface whose projecting amounts toward the backrest or stiffness thereof are made to be alternatively different between the front side of the body side surface for the sitting person and the rear side of its opposite side surface, only by switching the rear side and the front side by the rotation of the lumbar support portion, the abutment strength of the lumbar support portion for the body can be changed, and the strongly abutting position for the body can be moved.

Moreover, when the lumbar support apparatus of the present invention is configured such that the pad can be linearly moved along the surface of the base, and the projecting position and the projecting amount can be changed by the linear movement of the pad on the base, the abutment position of the lumbar support portion can be continuously moved in the height directions or the width directions of the backrest or in the both directions, so that the strongly abutting position for the body can be adjusted more precisely. Furthermore, the linear movement of the pad lessens or amplifies the movement amount of the lumbar support portion in the height directions or the width directions of the backrest when the lumbar support member is rotated, so that, within the lessening range, the movement amount of the lumbar support portion in the height directions or the width directions can be decreased, or the movement of the lumbar support portion can be limited only in the height directions or the width directions, and, within the amplifying range, the movement amount in the width directions or the height directions can be relatively increased with respect to the rotation amount of the lumbar support member so as to obtain a rapid change. This means that, within the movement stroke of the pad on the base, the space between the left and right lumbar support portions can be kept constant, without any mechanisms for keeping the space between the left and right lumbar support portions constant. Additionally, without changing the rotation range of the lumbar support member, the movement locus and the movement range of the abutment position can be extended by moving the position of the pad, i.e., the abutment position, on the lumbar support portion in the height directions or the width directions of the backrest, or inclined directions thereof.

BRIEF DESCRIPTION OF DRAWINGS

FIG. 27 is a back view illustrating only a pad of the above lumbar support portion.

FIG. 28 is a right side view of the above pad.

FIG. 29 is a left side view of the above pad.

DESCRIPTION OF EMBODIMENTS

Figure 1:
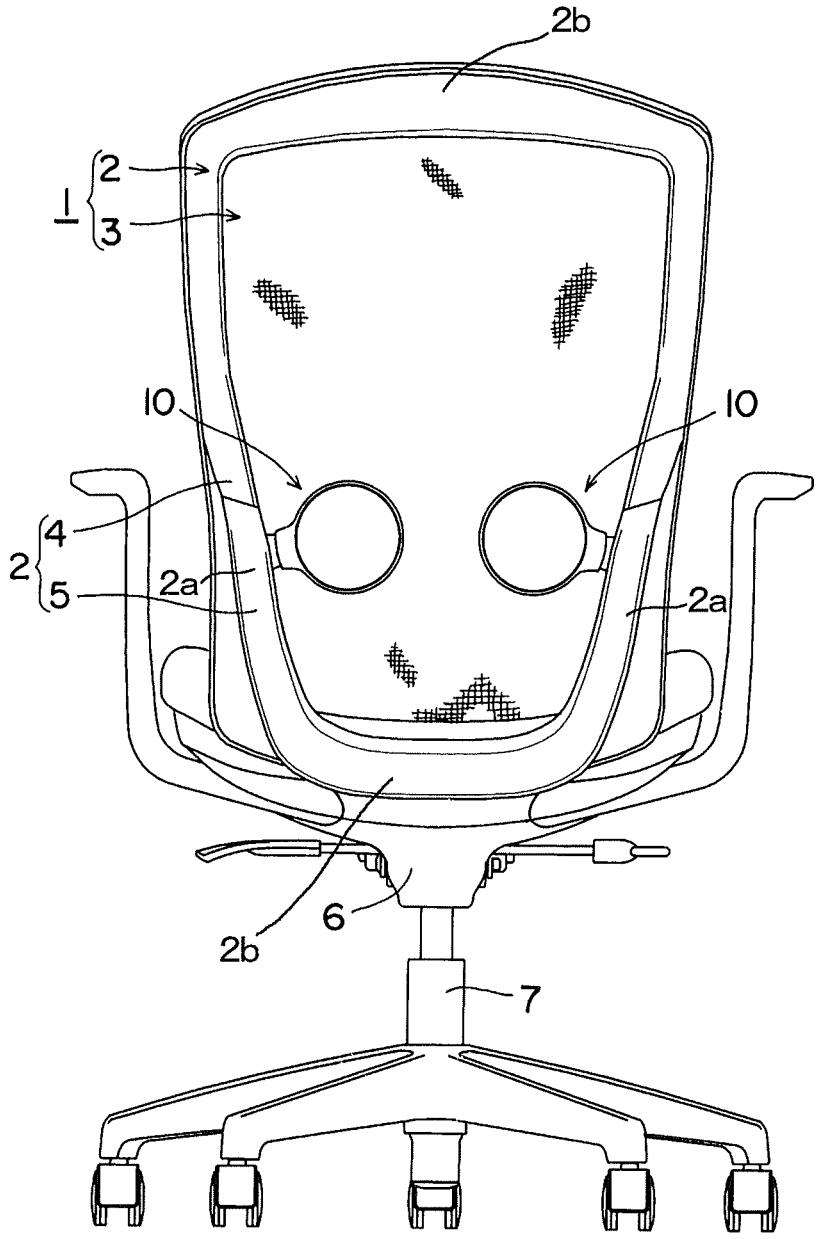
FIG. 1 is a back view illustrating an embodiment of a chair to which a lumbar support apparatus of the present invention is applied.
Figure 2:
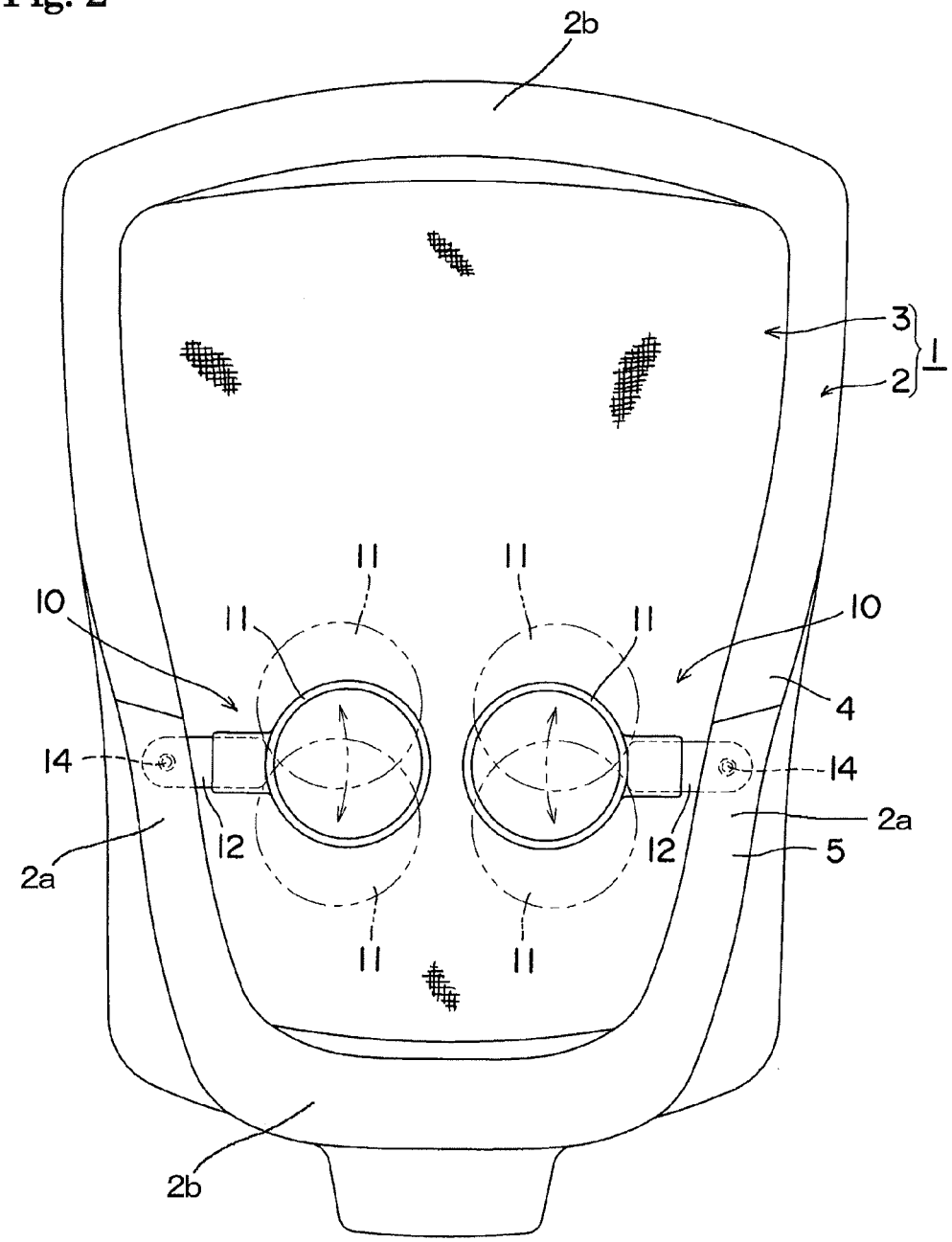
FIG. 2 is an enlarged back view illustrating a backrest of the chair of FIG. 1.
Figure 3:
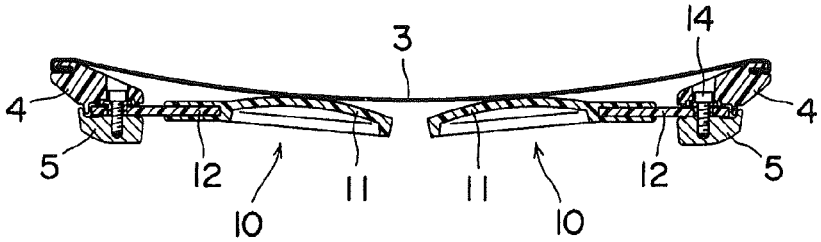
FIG. 3 is a transverse sectional view of the lumbar support apparatus portion of the backrest of FIG. 2.

A constitution of a backrest of a chair according to the present invention is described in detail hereunder based on an embodiment illustrated in the drawings. Note that, in this specification, respective directions "front and rear (forth and back)", "left and right", and "top and bottom (up and down)" are defined with respect to the sitting person on the chair, and the forward and backward directions of the chair or the backrest are called forth and back, the width directions are called left and right, and the height directions are called upward and downward. The term "back frame" used in this specification means a member which includes vertical sides supporting at least the opposing edges of the cover material forming the backrest surface, and constitutes the backrest with the cover material.

An embodiment of a chair to which a lumbar support apparatus of the present invention is applied is illustrated in FIGS. 1 to 5. The chair of this embodiment is provided with a leg 7 including casters, a main frame 6 attached to the upper end of a leg support post of the leg 7, a backrest 1 and a seat supported by the main frame 6 and a seat. The lumbar support apparatus is attached to a vertical side 2*a* adjacent to the lumbar portion of a back frame 2 so as to be disposed behind a cover material 3, so that the lumbar support apparatus supports the lumbar portion of the sitting person via the cover material 3. Here, the attachment position of the lumbar support apparatus to the back frame 2 is preferably set to the height of the lumbar portion of the sitting person having a standard physique who is supposed to be a user of the chair.

Here, in this embodiment, the back frame 2 is configured by two members including a cover material support frame 4 to which the cover material 3 is attached, and aback support member 5 which supports the cover material support frame 4 and attaches the same to the main frame 6. The cover material support frame 4 is molded by, for example, glass fiber reinforced nylon, in which the circumferential edge of the cover material 3 is fitted into a groove 9 formed at its circumferential edge so that the cover material 3 is stretched on the front side. On the other hand, the back support member 5 is formed by an aluminum die-casting, and constitutes the back frame 2 in conjunction with the cover material support frame 4 by connecting the lower half of the cover material support frame 4 thereto via a fixture such as a screw or pin. This back support member 5 is swingably attached to the main frame 6, and is provided with a force for continuously pressing the backrest 1 forward by a reaction force mechanism which is not shown.

In this embodiment, the cover material support frame 4 is formed in a substantially rectangular shape in which a pair of left and right vertical sides 2*a* are connected by horizontal sides 2*b* which connect the both vertical sides 2*a*. In a planer view, the horizontal sides 2*b* on the upper and lower sides of the frame are curved such that the central portions thereof are depressed backward. In a side view, each of the vertical sides 2*a* on the both sides of the frame is bent such that the upper edge side thereof and the lower edge side thereof, which are divided at the height position of the lumbar vertebra portion of the sitting person, are respectively inclined backward. As a whole, there is formed a three-dimensional curved surface which is bent in the forth and back directions such that the lumbar vertebra portion is the most forward-projecting portion along the height direction.

Note that, the cover material 3 can be made by any materials as long as the material can provide appropriate elasticity and strength as the backrest 1 in the state of being stretched over the cover material support frame 4. Namely, any elastic materials can be adopted for the cover material 3, and the material for the same is not limited to a specific material. Specifically, the cover material 3 may be formed by a highly elastic raw material as a main portion; for example, a double raschel mesh formed by weaving additionally elastic yarns, such as elastomeric yarns, in detail, a material which is formed by three-dimensionally weaving with a double raschel method the front cloth and the rear cloth of mesh fabric which are respectively elastically deformable, preferably having both a strength and a cushioning characteristic. For example, a polyester mesh sheet, various kinds of resin films, cloths, non-woven fabrics, and the like, are used. A locking plate 8 made of a rigid resin code is sewn to the edge of this cover material 3, and the edge of the cover material 3 is fitted into the groove 9 of the cover material support frame 4 together with the locking plate 8, so that the cover material 3 is stretched over the cover material support frame 4 and fixed to the same. When tension is applied to the cover material 3, and the cover material 3 is fitted into the groove 9 on the outer circumferential surface in a state of being covered on the cover material support frame 4, the locking plate 8 made of a rigid resin code is caught on the groove 9 by the tension of the cover material 3 so as to function as a retainer, thereby fixing the cover material 3 to the cover material support frame 4. Then, the locking plate 8 is formed by such a rigid material that the locking plate 8 is not easily bent so as not to come out from the state of being fitted into the groove 9. Specifically, the locking plate 8 is formed by synthetic resin having a predetermined rigidity, such as polypropylene.

The lumbar support apparatus is configured by two lumbar support members 10 which are separated into left and right parts. Each of the lumbar support members 10 include a lumbar support portion 11 which supports the lumbar vertebra portion and a stay portion 12 which supports the lumbar support portion 11. The end portion of the lumbar support stay portion 12 is attached to the back frame 2 so as to be rotatable via a rotation shaft 14. Accordingly, the lumbar support portion 11 at the distal end side is moved about the rotation shaft 14 so as to perform an arc movement so that the position thereof in the height direction can be adjusted.

Figure 5:
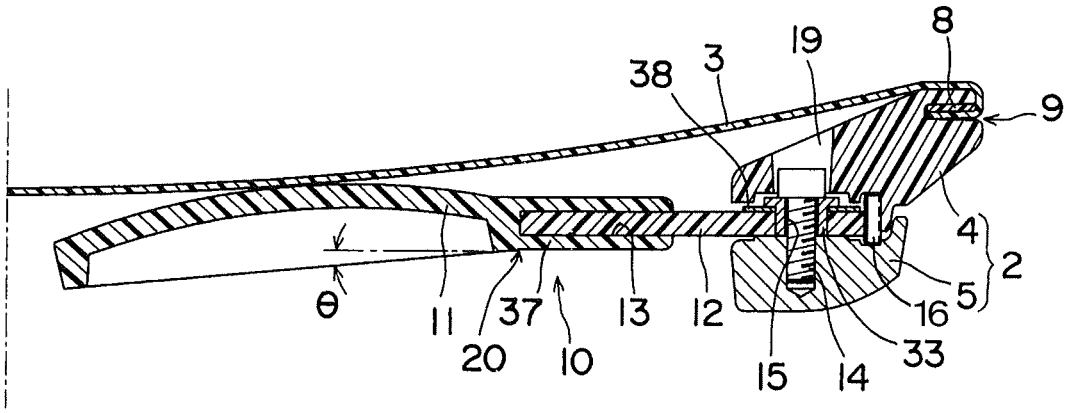
FIG. 5 is an enlarged cross-sectional view illustrating a relationship between the above lumbar support member disposed on the right side and a back frame.

Here, as illustrated in FIG. 5, the lumbar support portion 11 and the lumbar support stay portion 12 are preferably configured such that the lumbar support portion 11 is inclined so as to have a slight inclination θ with respect to the lumbar support stay portion 12. The inclination θ is preferably such an angle that the lumbar support portion 11 is made to be parallel with the opposite portion of the cover material 3, for example, about 5 to 8 degrees in this embodiment. On the other hand, the lumbar support stay portion 12 is disposed in a direction orthogonal to the rotation shaft 14 which is disposed to the back frame 2 in the forth and back directions of the chair. Therefore, even when the lumbar support member 10 is rotated about the rotation shaft 14, the lumbar support portion 11, which is inclined toward the rear side with respect to the lumbar support stay portion 12, is moved parallel with and along the cover material 3 opposite thereto. Accordingly, the distance from the lumbar support portion 11 to the cover material 3 is not changed, so that the force for supporting the lumbar vertebra portion of the sitting person is not fluctuated. Note that, the lumbar support portion 11 is bent with respect to the lumbar support stay portion 12 at the position 20. This embodiment is devised such that the lumbar support portion 11 is slightly inclined (by an angle θ) with respect to the lumbar support stay portion 12 so as to be abutted in a harmony against the cover material 3 of the backrest. However, this is not the only case, and the stay portion 12 itself may be attached to the back frame 2 so as to inclined thereto.

The lumbar support portion 11 is preferably provided with a convex portion which projects toward the front side. As illustrated in FIG. 5, for example, the convex portion is formed such that its central portion has a moderate spherical shape which projects toward the front side of the chair, i.e., toward the cover material 3, and its circumferential edge portion is provided with an annular flange for reinforcement. Therefore, the lumbar vertebra portion of the sitting person is softly pressed and elastically supported by the spherical surface. Moreover, the lumbar vertebra portion of the sitting person is supported by the central regions of the spherical convex portions existing at the positions which are certainly apart from the center line of the backrest to the left and right sides. Accordingly, even if the posture of the sitting person is deviated from the center line of the backrest, the back bone is not directly pressed by the convex portions. Note that, the shape of the convex portion on the front side of the circular lumbar support portion 11 is not specifically limited to the spherical shape which is concentric with the contour of the lumbar support portion 11 as illustrated in the drawings. The top portion may be deviated from the center of the above contour, a plurality of top portions may be disposed, and the convex portion may be non-spherical. Moreover, the shape of the lumbar support portion 11 is not specifically limited to a circular shape, and it is needless to say that any suitable shapes, such as an elliptical shape, a rectangular shape, or a polygonal shape, can be adopted according to the need.

The lumbar support portion 11 and the lumbar support stay portion 12 are configured by separate members, and they are preferably connected by being fitted into a sheath portion 37 which is formed at one of the lumbar support portion 11 and the lumbar support stay portion 12. In this embodiment, the distal end side of the lumbar support stay portion 12 is press-fitted into a hole 13 of the sheath portion 37 which is integrally formed with the lumbar support portion 11 so as to be integrated. In this case, suitable material can be selected for the lumbar support portion 11 and the lumbar support stay portion 12. For example, the lumbar portion 11 may be formed by polypropylene having softness, and the lumbar support stay portion 12 requiring more strength may be formed by glass fiber reinforced nylon. Then, the lumbar support stay portion 12 is rotatably attached at its proximal end side to the back frame 2 via the rotation shaft 14. In this embodiment, a screw is used for the rotation shaft 14. The screw 14 is screwed into the back support member 5 via a sleeve 33 with flange which is passed through the proximal end portion of the lumbar support stay portion 12. The sleeve 33 with flange is attached to the back support member 5 of the back frame 2. Therefore, the lumbar support stay portion 12 is rotatably supported by the sleeve 33 with flange. There is formed a hole 19 by which the screw 14 is passed through the cover material support frame 4. A washer 38 is interposed between the flange of the sleeve 33 and the lumbar support stay portion 12.

Figure 4:
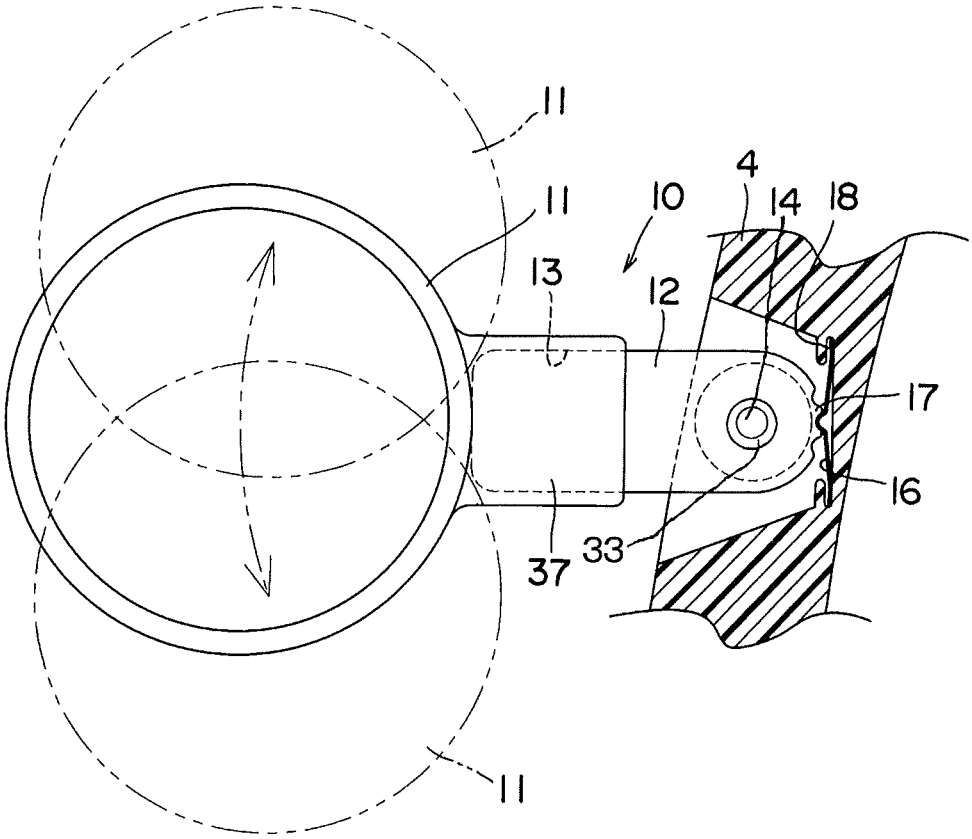
FIG. 4 is an enlarged back view illustrating a member disposed on the right side of the lumbar support apparatus of FIG. 1.

Here, between the back frame 2 and the lumbar support member 10, a positioning mechanism is preferably disposed for preventing the lumbar support member 10 from sliding down due to its self-weight. The positioning mechanism is configured to increase the force for fixing the lumbar support member 10 to the back frame 2 by means of a frictional force or an engagement by an elastic member. In this embodiment, an uneven portion 17 is formed at one of the lumbar support stay portion 12 and the back frame 2, and the other is provided with an elastic member 16 which is fitted into the uneven portion 17, thereby providing an appropriate resistance (in other words, an intermittency resistance) to the rotation of the lumbar support stay portion 12. Specifically, as illustrated in FIG. 4 and FIG. 5, the uneven portion 17 is formed at a position where the force for fixing the lumbar support member 10 to the back frame 2 is less affected, for example, the circumferential edge of the lumbar support stay portion 12. There is provided at the back frame 2 side a plate spring member 16 including a convex portion or a concave portion which is made by an elastic member so as to be fitted into the uneven portion 17, thereby providing an appropriate resistance (click feeling) to the rotation of the lumbar support stay portion 12. The elastic member 16 is not limited to the plate spring member illustrated in the drawings, and may be a ball plunger fitted into the uneven portion 17, or a spring mechanism in which a roller movable in forth and back directions toward the uneven portion 17 along a retainer is pressed from its back side by an elastomer. Of course, the positioning mechanism is not limited to those which are positioned between the circumferential portion of the lumbar support stay portion 12 which is parallel with the rotation shaft 14 and the back frame 2 opposing thereto. In some cases, the positioning mechanism may be formed between the opposing surfaces of the lumbar support stay portion 12 and the back support member 5 which are fastened by the screw 14. The positioning mechanism is not limited to the combination of the uneven portion 17 and the elastic member 16 fitted thereto, and may be a mechanism which performs a continuously variable positioning of the lumbar support member by increasing the friction between the lumbar support stay portion 12 and the back frame 2, so as to prevent the lumbar support member from sliding down due to its self-weight. Note that, the both ends of the plate spring 16 are received by claws 18.

Moreover, although it is not shown, a positioning mechanism is preferably disposed between the sheath portion 37 of the lumbar support portion 11 and the lumbar support stay portion 12 so that the space between the left and right lumbar support portions 11 can be changed. The positioning mechanism can be easily configured by forming an uneven portion like that illustrated in FIG. 4 on the lumbar support stay portion 12, and incorporating a spring member, which is fitted into the uneven portion, into the sheath portion 37. With this, the positioning can be performed when the lumbar support portion is pulled out of or retracted into the lumbar support stay portion.

Figure 6:
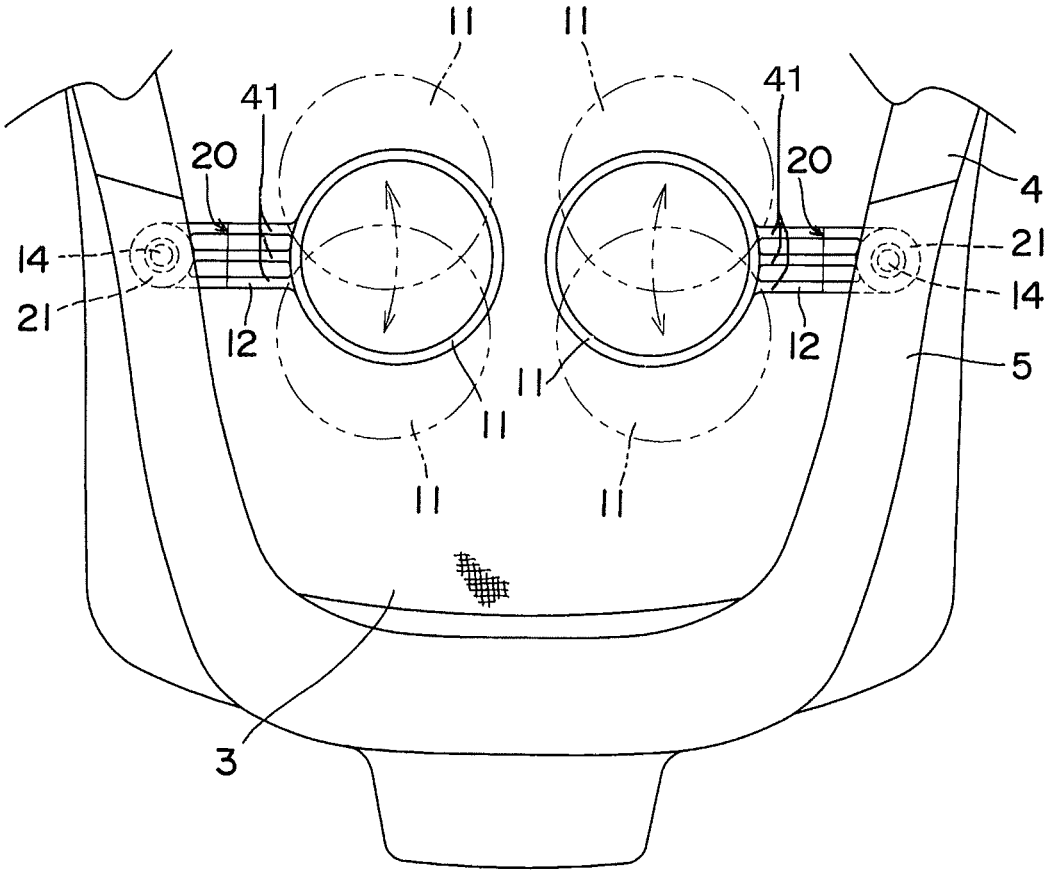
FIG. 6 is a back view illustrating a second embodiment of a lumbar support apparatus of the present invention.
Figure 7:
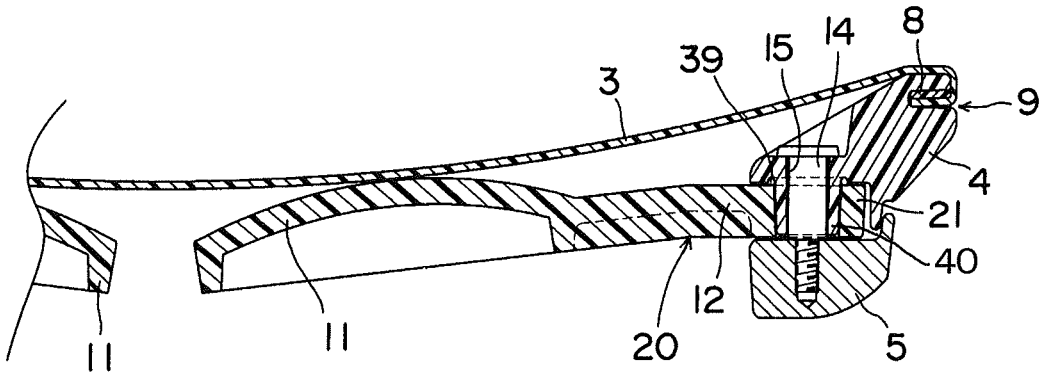
FIG. 7 is an enlarged cross-sectional view of the lumbar support apparatus of the second embodiment.

The lumbar support member 10 may be configured by preliminary molding the lumbar support portion 11 and the lumbar support stay portion 12 integrally, for example, as illustrated in FIG. 6 and FIG. 7. In this case, in order to reinforce the strength of the lumbar support stay portion 12, preferably, a boss portion 21 is formed at the portion where the rotation shaft 14 is passed through, and a rib 41 is formed between this boss portion 21 and the lumbar support portion 11 as illustrated in the drawings. In this embodiment, a cylindrical shaft portion 40 is formed at the cover material support frame 4, and the cylindrical shaft portion 40 is fitted into the boss portion 21 of the lumbar support stay portion 12, so that the sleeve 33 with flange and the washer 38 which are separate members become needless. The below-neck part of the rotation shaft 14 is contained in the hole 15 of the cylindrical shaft portion 40, and the screw portion at the distal end is screwed into the back support member 5, so that the boss portion 21 of the lumbar support stay portion 12 is rotatably attached to the back support member 5. Accordingly, the positioning mechanism is configured to have a structure which enables a continuously variable fixing by a frictional force by disposing an O-ring 39 between the cover material support frame 4 and the boss portion 21 of the lumbar support stay portion 12.

Figure 8:
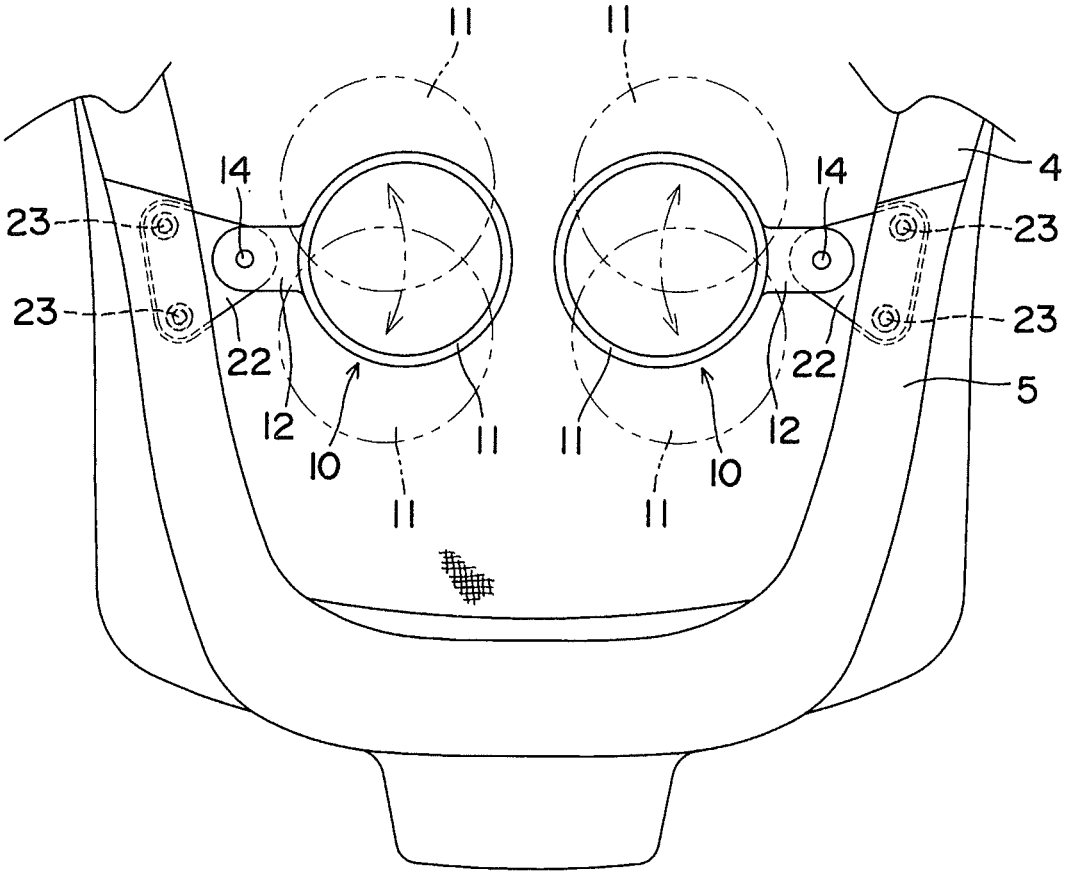
FIG. 8 is a back view illustrating a third embodiment of a lumbar support apparatus of the present invention.
Figure 9:
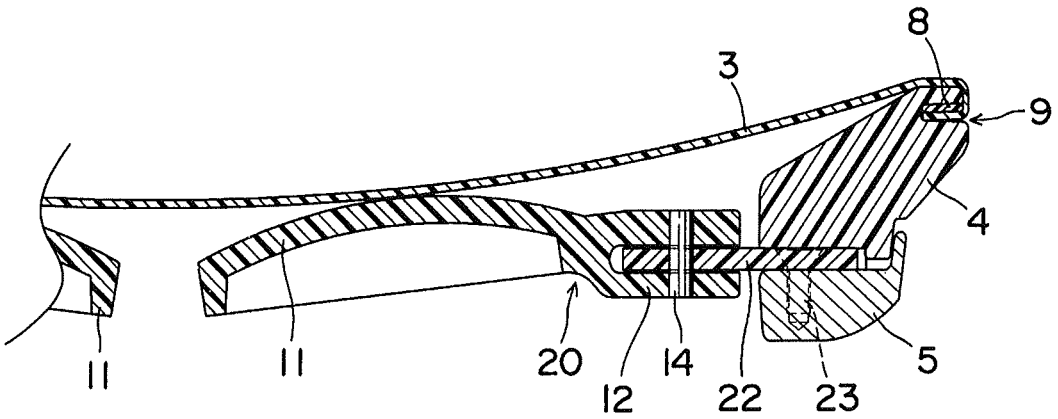
FIG. 9 is an enlarged cross-sectional view of the lumbar support apparatus of the third embodiment.
Figure 10:
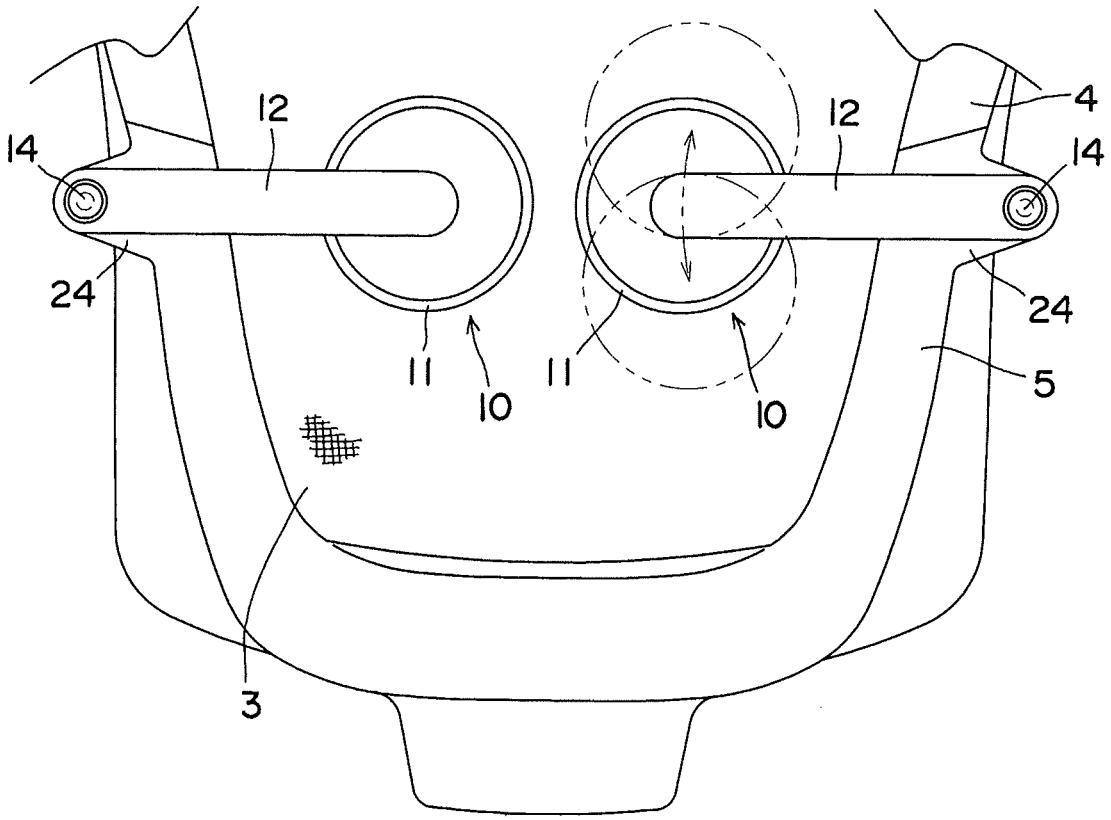
FIG. 10 is a back view illustrating a fourth embodiment of a lumbar support apparatus of the present invention.
Figure 11:
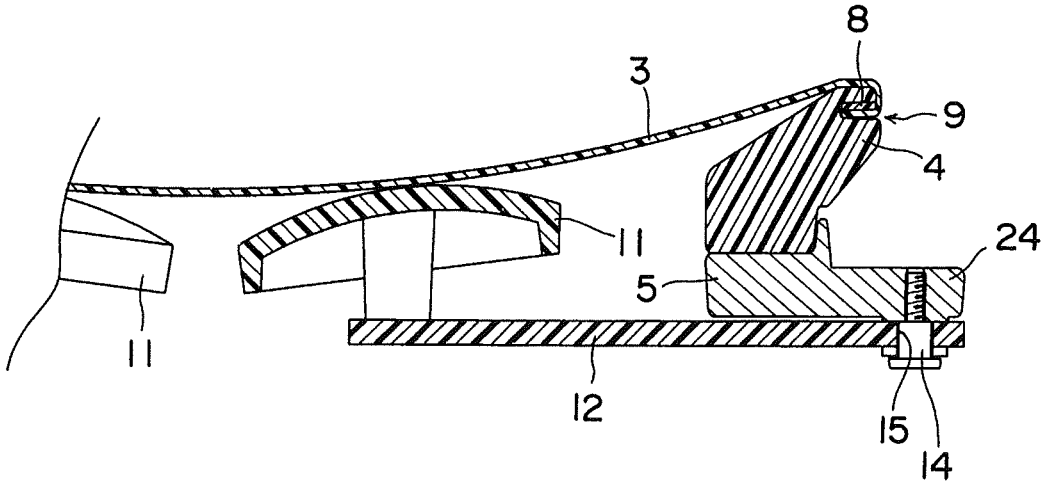
FIG. 11 is an enlarged cross-sectional view of the lumbar support apparatus of the fourth embodiment.

In the above-mentioned embodiment, the rotation shaft 14 is disposed at the vertical side of the back frame 2, and the lumbar support member 10 is attached so as to project from the lateral side of the backrest 1 to the inner side. However, the position of the rotation shaft 14, i.e., the attachment position of the lumbar support member 10, is not limited to this, and may be an inside of the back frame 2, or an outside of the back frame 2. For example, as illustrated in FIGS. 8 and 9, a bracket 22 may be attached to the back support member 5 via a screw 23 so as to project into the inner space surrounded by the back frame 2, and the rotation shaft 14 may be disposed at the distal end side of this bracket 22 so that the lumbar support stay portion 12 is flexibly attached thereto. In this case, the length of the lumbar support member 10 becomes shorter so that the supporting rigidity can be enhanced without changing its material. Moreover, as illustrated in FIGS. 10 and 11, a bracket portion 24 may be formed such that a portion thereof, to which the rotation shaft 14 of the back support member 5 is attached, projects outward, and the lumbar support stay portion 12 may be attached to the space outside the back frame 2. In this case, the length of the lumbar support member 10 becomes longer, and the rotation radius of the lumbar support portion 11 becomes larger, so that the change of the space between the left and right lumbar support portions 11 is few when performing an adjustment of their height positions. Note that, in the embodiment of FIGS. 10 and 11, the inclination θ of the lumbar support portion 11 with respect to the lumbar support stay portion 12 is obtained by disposing the lumbar support portion 11 with an inclination with respect to the linear lumbar support stay portion 12.

Figure 12:
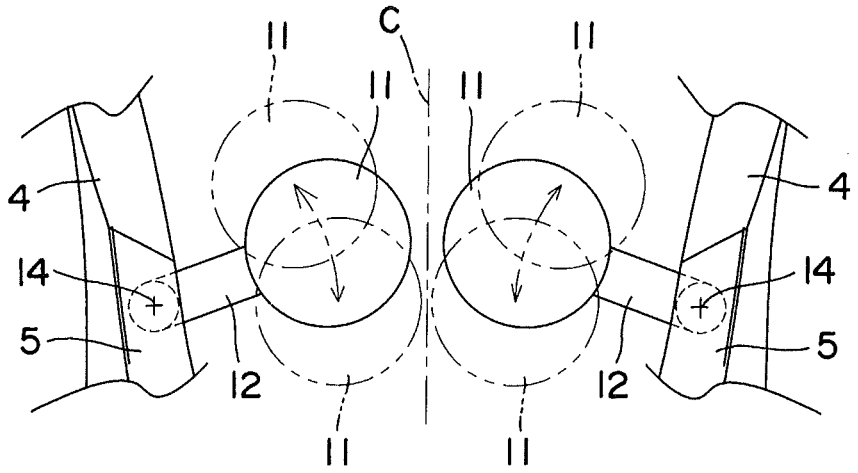
FIG. 12 is a back view illustrating a fifth embodiment of a lumbar support apparatus of the present invention.
Figure 13:
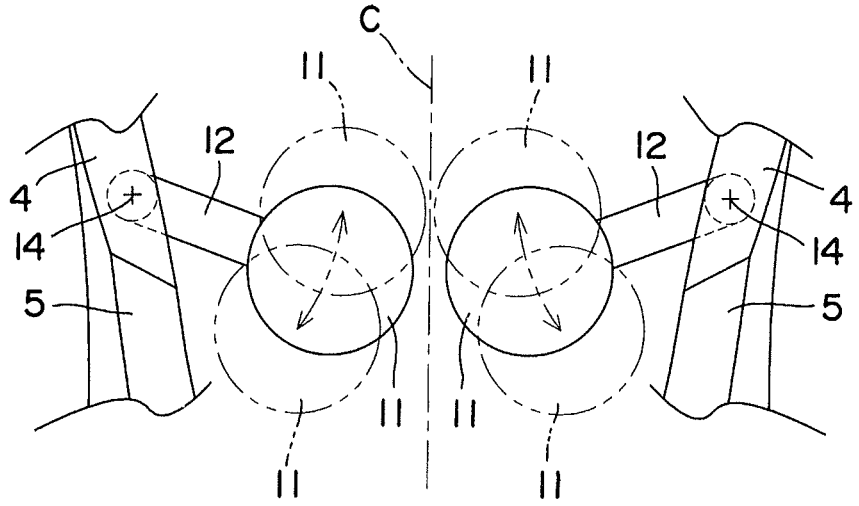
FIG. 13 is a back view illustrating a sixth embodiment of a lumbar support apparatus of the present invention.

In the above-mentioned embodiment, the lumbar support member 10 is configured to be rotatable about the rotation shaft 14 in both the upward and downward directions, but this is not the only case. In some cases, as illustrated in FIG. 12 and FIG. 13, the lumbar support member 10 may be attached so as to be swingable only toward either the upper side or the lower side with respect to the line segment connecting the attachment points of the left and right lumbar support members 10 to the back frame, i.e., the rotation shafts 14, with each other, so that the height thereof can be adjusted by swinging the lumbar support member. Not only for the embodiments of FIG. 12 and FIG. 13, but also for any embodiments in which the two lumbar support members 10, which are separated into left and right parts, become opposite to each other when the two lumbar support members 10 approach each other the most closely, the two separate lumbar support portions 11 are preferably configured to have a space therebetween, when the two lumbar support members 10 approach each other the most closely, such that the space is created so as to be larger than or equal to the width of the back bone even at the position where the distance from the vertical direction center C of the backrest is minimum. With this, the direct abutment of the back bone against the lumbar support member is less likely when the sitting person leans on the backrest. However, even if the back bone is directly abutted against the lumbar support portion 11, the abutment against the lumbar vertebra portion of the sitting person can be made soft by the deflection of the lumbar support member 10 which is cantilevered.

Figure 14:
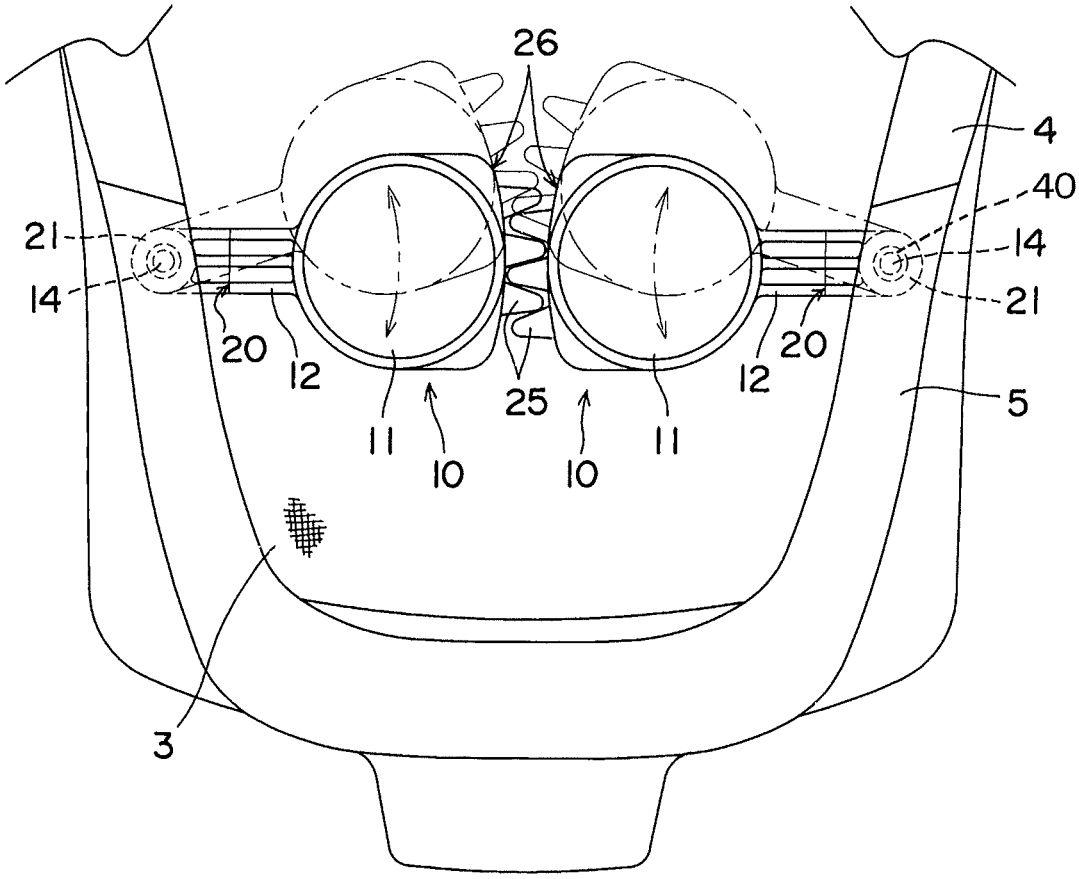
FIG. 14 is a back view illustrating a seventh embodiment of a lumbar support apparatus of the present invention.
Figure 15:
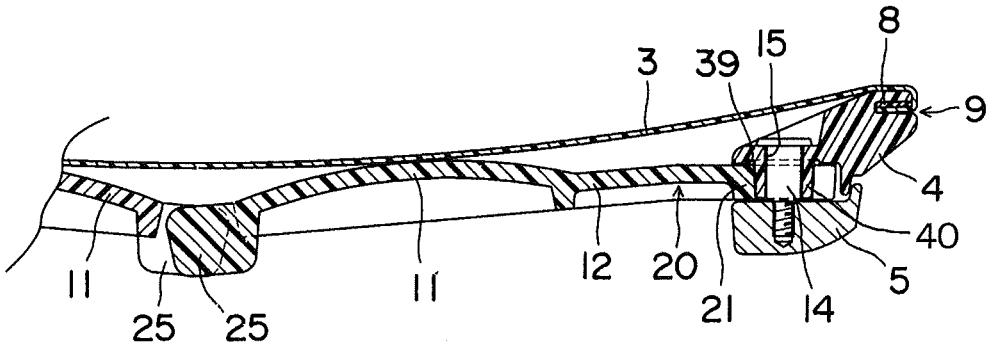
FIG. 15 is an enlarged cross-sectional view of the lumbar support apparatus of the seventh embodiment.

The two lumbar support members 10 which are separated into left and right parts do not need to be moved individually for the left and right parts, and can be configured so as to be coordinately moved with each other by coordinating the two lumbar support members 10 only in the rotation directions. For example, as illustrated in FIGS. 14 and 15, gears 26 are formed on the inner arc surfaces of the opposing lumbar support portions 11 of the lumbar support members 10 disposed on the left and right sides. Accordingly, by meshing these gears 26 with each other, the two lumbar support members 10 have a non-linkage relationship such that they are moved independently from each other in the forth and back directions of the chair, and in the rotation directions, the two lumbar support members 10 are simultaneously rotated by the meshing of the gears 26. In this case, when one of the lumbar support members 10 is moved, the other of the lumbar support members 10 is moved by the same amount, so that the height adjustment of the lumbar support members 10 becomes easy. Note that, the inner arc surface of the lumbar support portion 11 and the gear 26 are parts of the gears of a base circle having a center of curvature at the rotation shaft 14.

Figure 16:
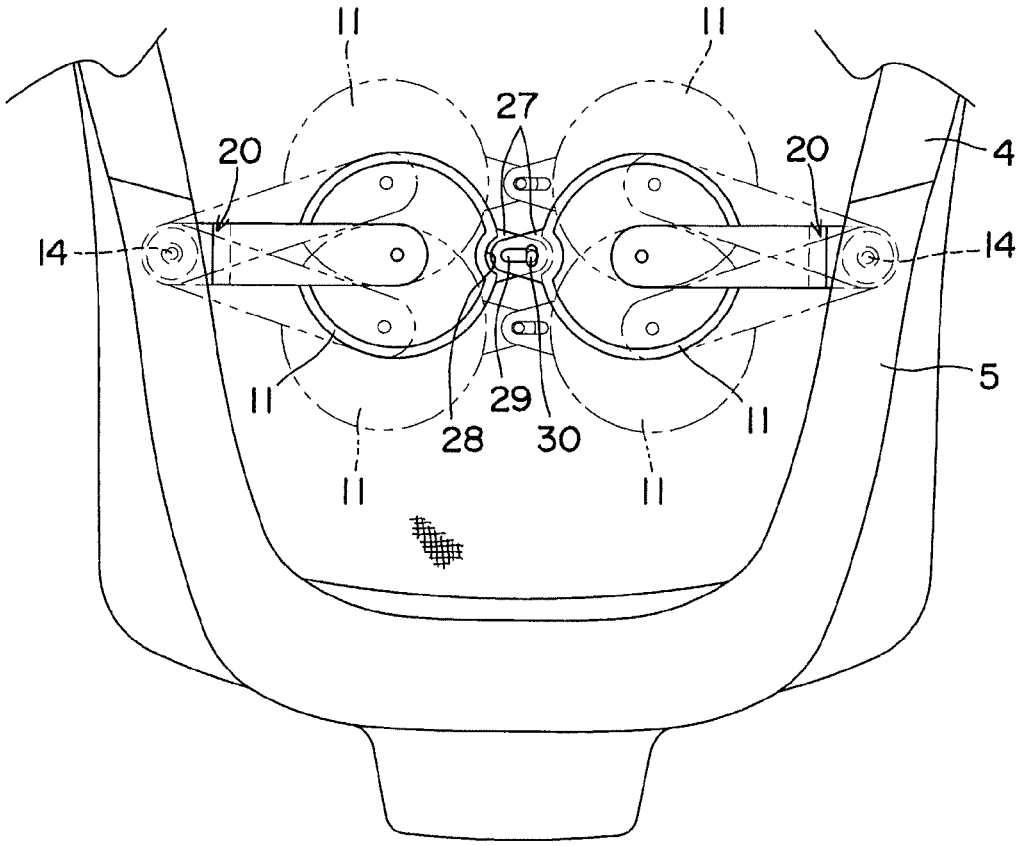
FIG. 16 is a back view illustrating an eighth embodiment of a lumbar support apparatus of the present invention.
Figure 17:
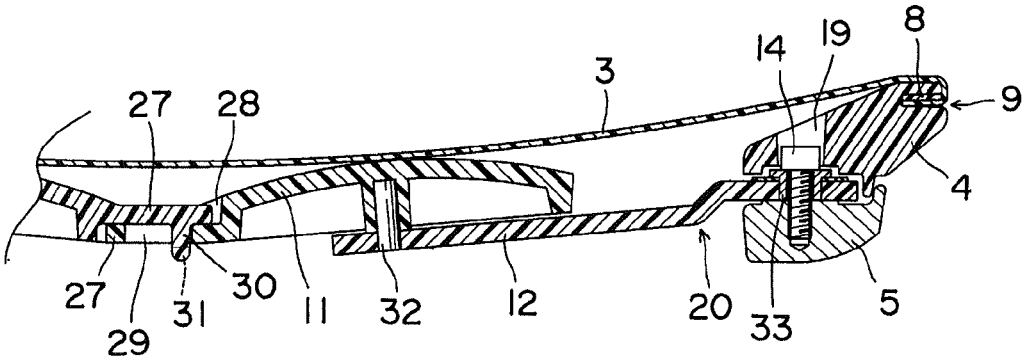
FIG. 17 is an enlarged cross-sectional view of the lumbar support apparatus of the eighth embodiment.

As illustrated in FIGS. 16 and 17, an oblong hole 29 may be formed at one of the left and right lumbar support portions 11, and a connection pin 30 passing through the oblong hole 29 may be provided at the other. With this, the lumbar support portions 11 are coordinated with each other in the rotation directions, and are slidable in the horizontal directions (i.e. the directions in which the lumbar support portions 11 are moved toward each other or away from each other), and are connected to each other with a play in the forth and back directions of the chair. A respective connection link 27 projects from each of the lumbar support portions 11, and the oblong hole 29 is disposed at one link 27, and the connection pin 30 is disposed at the other link 27. A flange 31 across the oblong hole 29 is formed at the distal end of the connection pin 30, so that the connection pin 30 is prevented from coming out of the oblong hole 29. The distal end of the connection link 27 is formed in an arc-shape, and a corresponding concave portion 28 is formed at the lumbar support portion 11 on the opposing counterpart side, so that the space between the left and right lumbar support portions 11 is intended to be minimized. The lumbar support portion 11 is rotatably connected to the lumbar support stay portion 12 via a pin 32, so that the lumbar support portion 11 is rotated in the direction reverse to the direction of the lumbar support stay portion 12 when being rotated, and the directions of the left and right lumbar support portions 11, which are connected via the connection pin 30 passing through the oblong hole 29, are kept constant. Therefore, when grasping one or both of the lumbar support stay portions 12 and rotating the same, the connection pin 30 is slidably moved within the oblong hole 29 simultaneously by the same amount in the upward and downward directions, while the space between the left and right lumbar support portions 11 is being changed. Note that, because the lumbar support stay portion 12 in this embodiment enables the lumbar support portion 11 to rotate, the bending position 20 is set adjacent to the rotation shaft 14.

Figure 18:
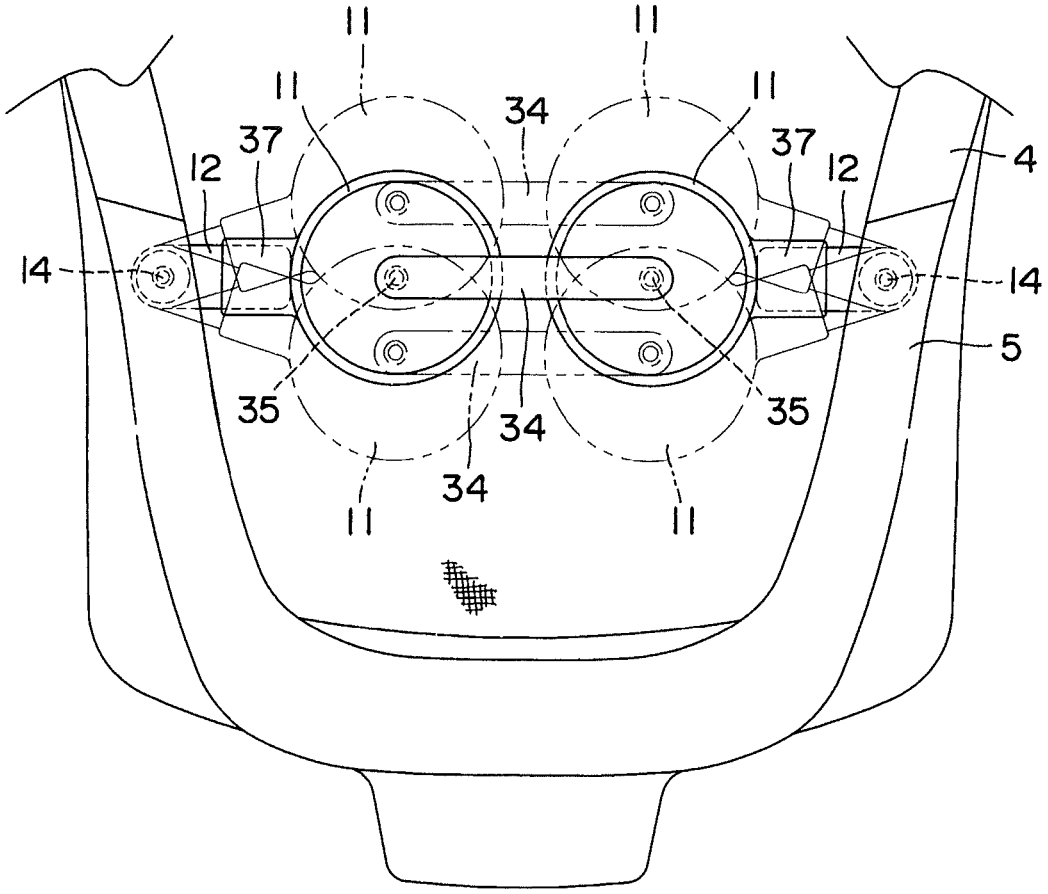
FIG. 18 is a back view illustrating a ninth embodiment of a lumbar support apparatus of the present invention.
Figure 19:
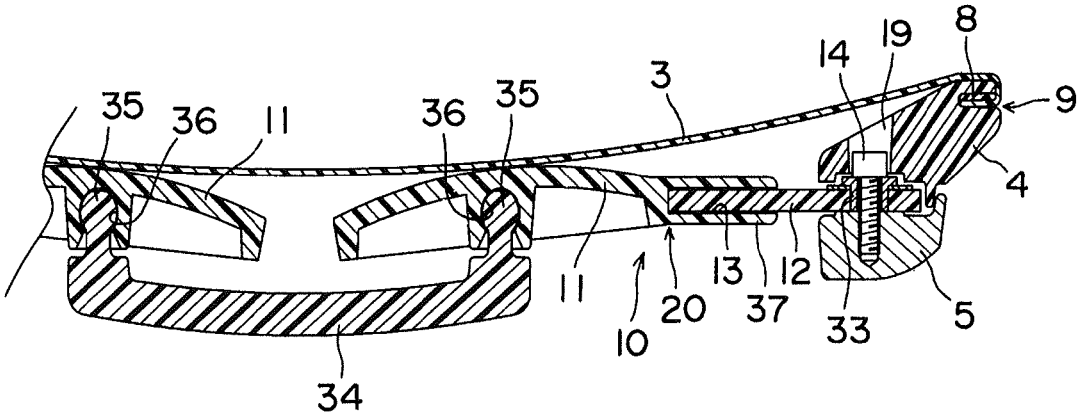
FIG. 19 is an enlarged cross-sectional view of the lumbar support apparatus of the ninth embodiment.

Moreover, as illustrated in FIGS. 18 and 19, a separate link 34 may be bridged between the left and right lumbar support portions 11 so as to be integrally moved. For example, the lumbar support portion 11 and the lumbar support stay portion 12 are configured by separate members. The lumbar support portion 11 is connected with the lumbar support stay portion 12 so as to be longitudinally slidable, and the left and right lumbar support portions 11 are rotatably connected with each other via a link 34. Preferably, the lumbar support portion 11 and the link 34 are configured such that, for example, a spherical protrusion 35 is disposed on the link 34 side, and a spherical seat 36 is disposed at the center of the lumbar support portion 11, thereby forming a spherical bearing by both of them so as to be rotatably connected. Moreover, between the sheath portion 37 of the lumbar support portion and the lumbar support stay portion 12 fitted into the same, a positioning mechanism, such as the uneven portion and the spring member fitted into the same as illustrated in FIG. 4, may be disposed, so that a positioning can be performed when the lumbar support portion 11 is pulled out of and retracted into the lumbar support stay portion 12.

Not only for the embodiment of FIGS. 14 and 15, the surfaces opposing at least between the lumbar support portions 11 disposed on the left and right sides are preferably formed in arc surfaces or ellipsoids. In this case, even then the left and right lumbar support members 10 are closely positioned to each other, the interferences between the opposing surfaces by the arc movement are minimized. On the other hand, the separated two parts of the lumbar support member 10 are preferably positioned apart from the center C of the backrest by a given distance, and more preferably, even at the narrowest position, there is formed a space wider than the width of the back bone. With this, the possibility of the abutment of the back bone against the lumbar support member 10 becomes low. Moreover, even when the abutment occurs, the lumbar support members 10 are supported by the lumbar support stay portions which are separated from each other and cantilevered, so that the abutment against the lumbar vertebra portion of the sitting person can be made soft.

Figure 20:
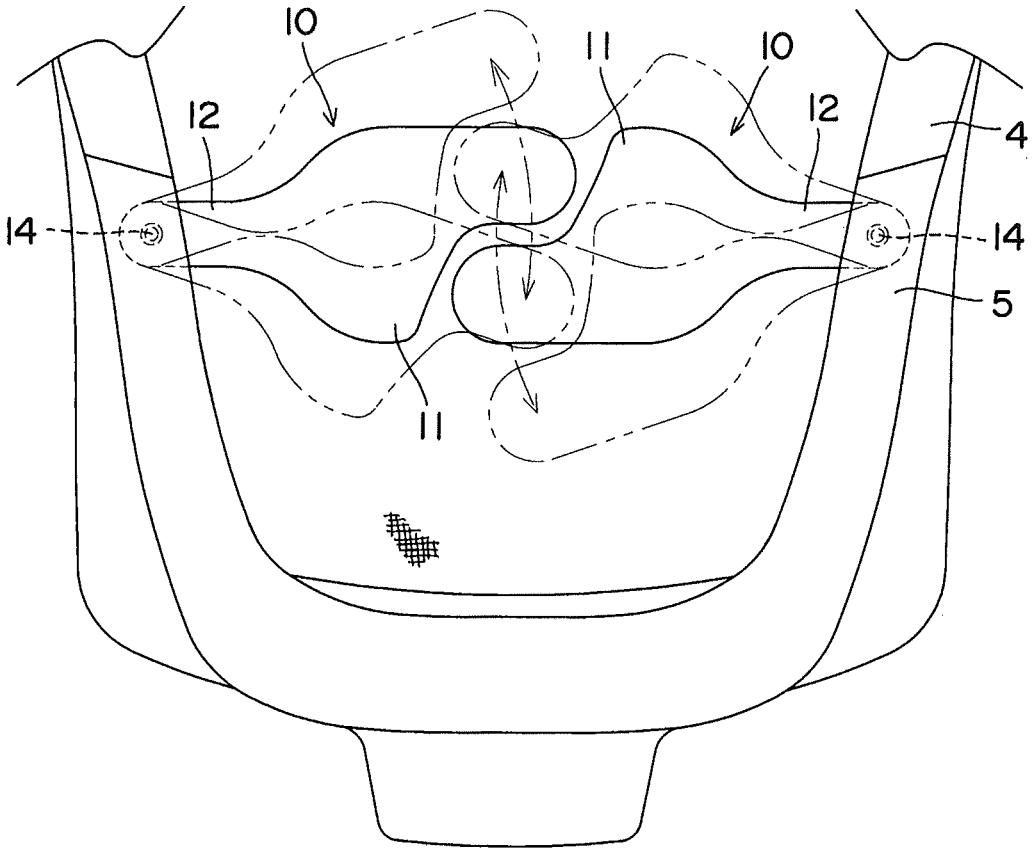
FIG. 20 is a back view illustrating a tenth embodiment of a lumbar support apparatus of the present invention.
Figure 21:
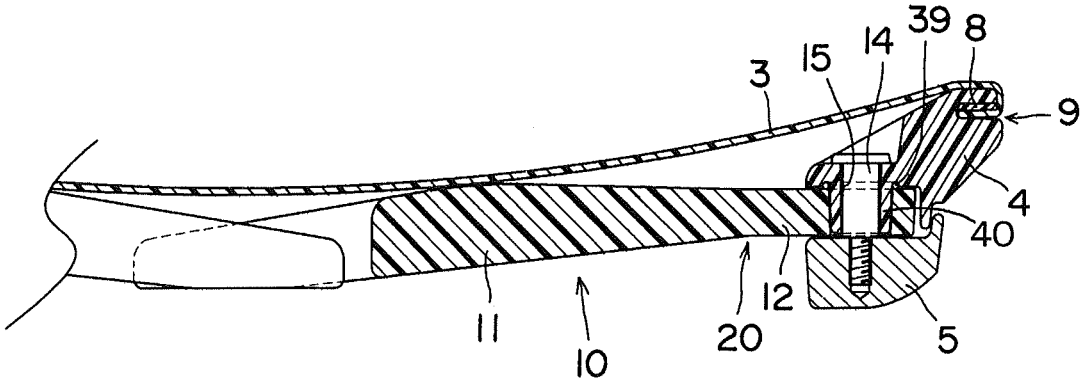
FIG. 21 is an enlarged cross-sectional view of the lumbar support apparatus of the tenth embodiment.
Figure 22:
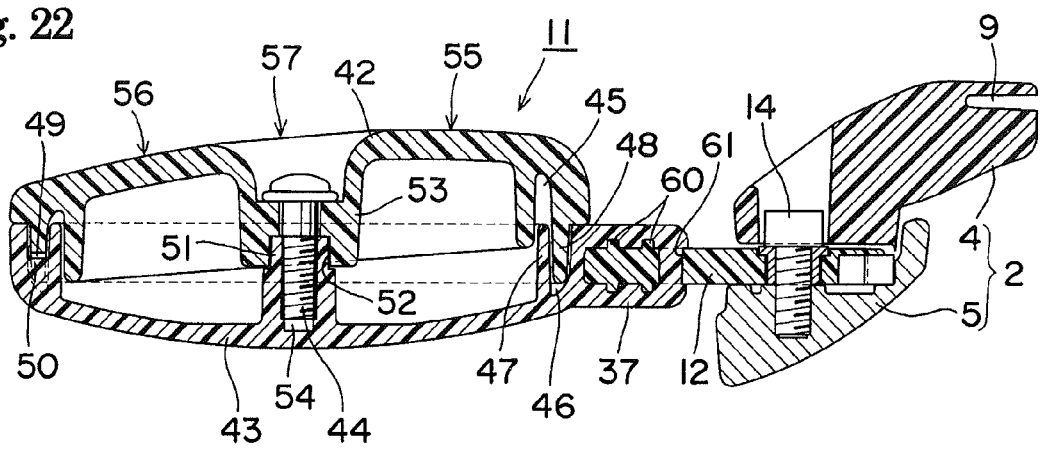
FIG. 22 is a central and vertical sectional view illustrating an eleventh embodiment of a lumbar support apparatus of the present invention.
Figure 23:
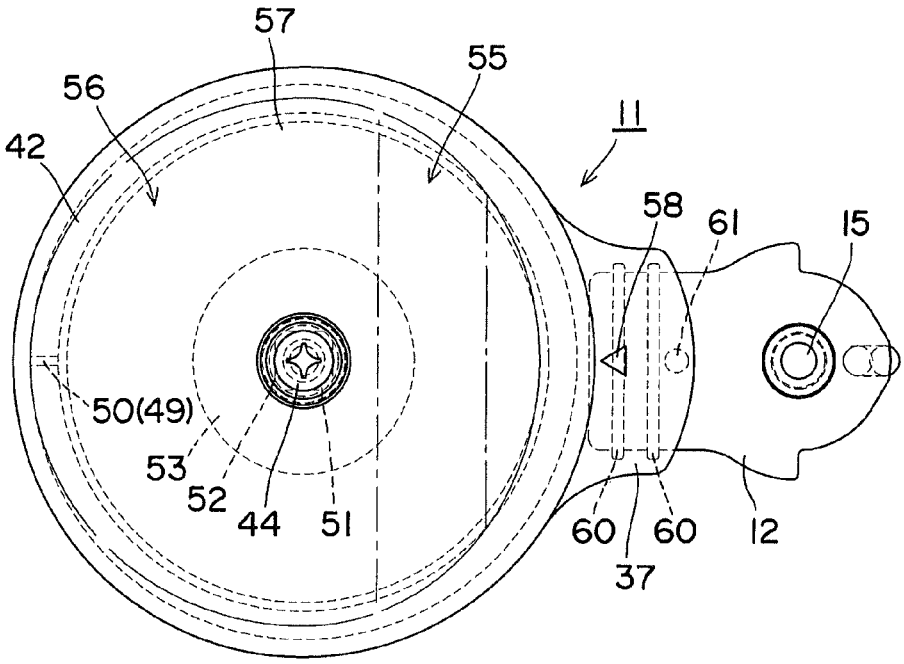
FIG. 23 is a front view of a lumbar support portion of the eleventh embodiment.
Figure 24:
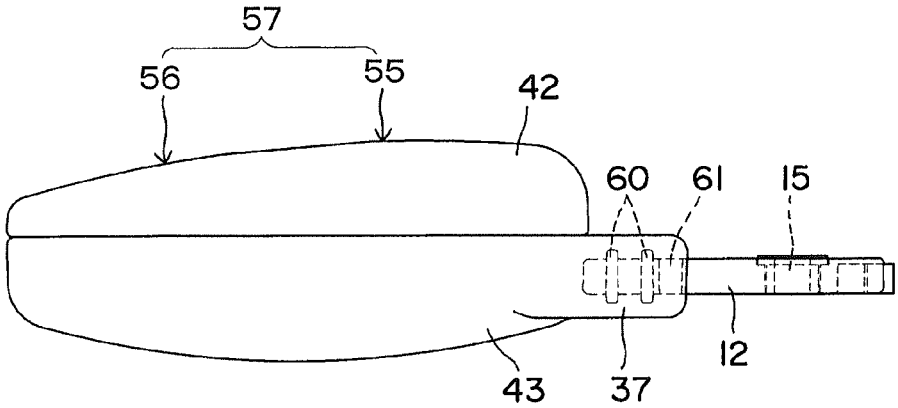
FIG. 24 is a plan view of the above lumbar support portion.
Figure 25:
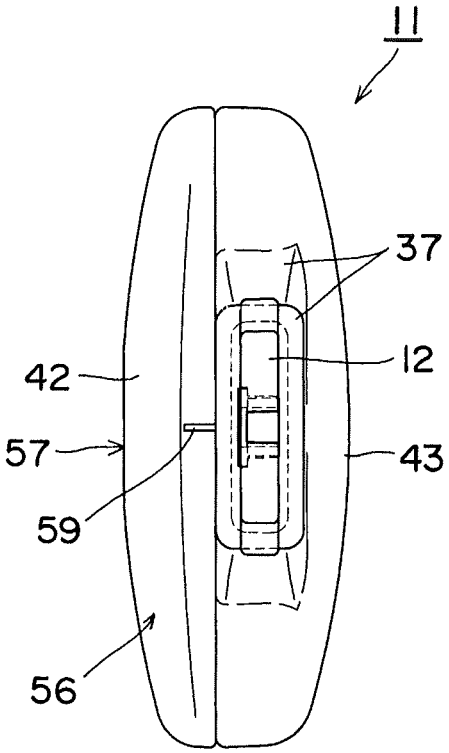
FIG. 25 is a right side view of the above lumbar support portion.
Figure 26:
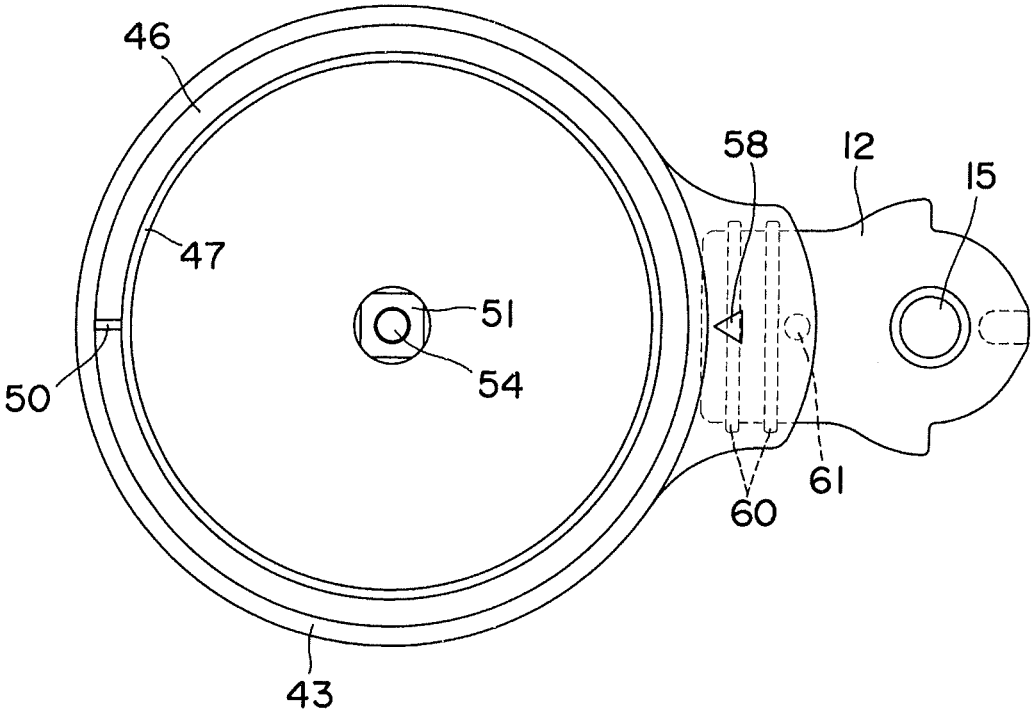
FIG. 26 is a front view illustrating only a base by disassembling the above lumbar support portion.

Of course, the mode of the lumbar support members 10, which are separated into two parts, is not limited to that mentioned above. For example, as illustrated in FIGS. 20 and 21, a mode in which the free end sides of the lumbar support members 10 protrude beyond the center of the backrest can be adopted. In this case, the lumbar support portion 11 has a shape projecting toward the front side such that the cover material 3 is supported at a position apart from the center of the backrest, namely a position apart from the back bone. Then, in the region adjacent to the center of the backrest, the area of the lumbar support portion 11 is decreased, and the space between the cover material 3 and the lumbar support portion 11 is increased, so that the force supporting the lumbar vertebra portion adjacent to the back bone can be made relatively small, thereby making the abutment against the back bone of the sitting person soft.

The lumbar support apparatus of the thus constituted embodiment is positioned behind the cover material 3, and is exposed at the rear side of the backrest 1. Then, the height adjustment of the lumbar support member 10 can be performed by grasping the lumbar support member 10 and swinging the same about the rotation shaft 14 in any direction, i.e., upward or downward. At this time, if the lumbar support stay portion 12 can be fixed in stages with respect to the back frame 2, one of the predetermined fixing positions is to be selected, and if the lumbar support stay portion 12 can be fixed in a continuously variable manner, the positioning is completed when releasing the hand at any position. When the left and right lumbar support portions 11 are configured so as to be coordinately moved, only by operating one lumbar support portion 11, the other lumbar support portion 11 is adjusted at the same height. On the other hand, when the left and right lumbar support portions 11 are configured so as to be independently moved from each other, by operating the left and right lumbar support portions 11 by any amount or direction, respectively, the lumbar support members can be independently adjusted to respective preferable positions in the height directions, so that a subtle inclination or deviation of the posture or trunk can be addressed. Namely, even when the posture of the sitting person is inclined, or the sitting person tends to sit out of upright, because the left and right lumbar support members can be independently adjusted so as to ensure appropriate height positions, no deviation is generated between the position of the lumbar vertebra of the sitting person and the supporting direction of the lumbar plate, so that a feeling of stability about the sitting posture may be sufficiently obtained.

Moreover, when the lumbar support members 10 are separated into the left and right parts and are respectively rotated about the rotation shafts 14, the space between the both lumbar support portions 11 becomes larger as their height positions move apart from the line segment connecting the left and right rotation shafts 14 in the upward and downward directions. However, as the relationship between the lumbar support portion 11 and the lumbar support stay portion 12 illustrated in FIGS. 18 and 19, if the lumbar support member 10 is configured to be extendable, the deviation of the space between the left and right lumbar support portions 11 can be avoided. Moreover, if the lumbar support member 10 is configured to be extendable, the deflection amount can be adjusted.

In the respective embodiments, the shape of the convex portion on the front side of the lumbar support portion 11 is formed in a symmetrical spherical shape so that similar abutment strengths can be obtained in any direction and position. However, as illustrated in FIGS. 22 to 44, by forming a non-symmetrical shape which is not spherical, or forming a region whose elasticity is partially different, the surface 57 of the lumbar support portion 11 for supporting the body of the sitting person (which is called "abutment surface") may be configured to include a plurality of support regions for providing different abutment strengths, so that the different abutment strengths can be obtained. Note that, detailed descriptions about the parts and constitutions identical with those of the embodiments illustrated in FIGS. 1 to 21 are omitted.

For example, FIGS. 22 to 29 illustrate an embodiment whose abutment surface 57 against the body is non-spherical. The lumbar support portion 11 of this embodiment is formed by a pad 42 disposed on the body side, and a base 43 supporting the pad 42, which are connected with each other via a screw 44 at its center so as to be integrated. The base 43 is molded by synthetic resin, such as polyurethane elastomer, adjusted to a material which is more rigid than the pad 42. The pad 42 is molded by synthetic resin, such as polyurethane elastomer, adjusted to a rigidity which performs an appropriate elasticity when the pad 42 is applied to the body. In this embodiment, the base 43 and the pad 42 include at their circumferential edge portions annular grooves 45, 46 which are fitted into each other. Each of the base 43 and the pad 42 includes a shaft portion 51 having at its central portion a threaded screw hole 54 into which the screw 44 for connection is screwed, and a boss portion 53 which is fitted into the shaft portion 51. Then, the base 43 and the pad 42 are connected with each other by screwing the screw 44 to the threaded screw hole 54 of the shaft portion 51 under a state in which the shaft portion 51 and the boss portion 53 are fitted into each other. The pad 42 and the base 43 are configured to have a shell structure whose inside is hollow in order to obtain elasticity. Annular grooves 47, 48 and annular protrusions 47, 48, which are doubly formed at the circumferential edge portions, are fitted into each other, and a hole 52 of a boss portion 53 provided at the center and a shaft portion 51 are fitted into each other and connected by the screw 44. As a result, the pad 42 and the base 43 are integrated as a structure having a certain degree of rigidity, while ensuring a certain degree of elasticity. Note that, the concave portion for inserting the screw 44 into the boss portion 53 is deeply depressed with a large curved surface such that no corner portion is formed on the abutment surface 57 side, and is provided such that the head of the screw 44 does not protrude into the abutment surface 57. The circumferential edge portions of the pad 42 and the base 43 are also formed in large curved surfaces in order not to form an acute corner.

Figure 37:
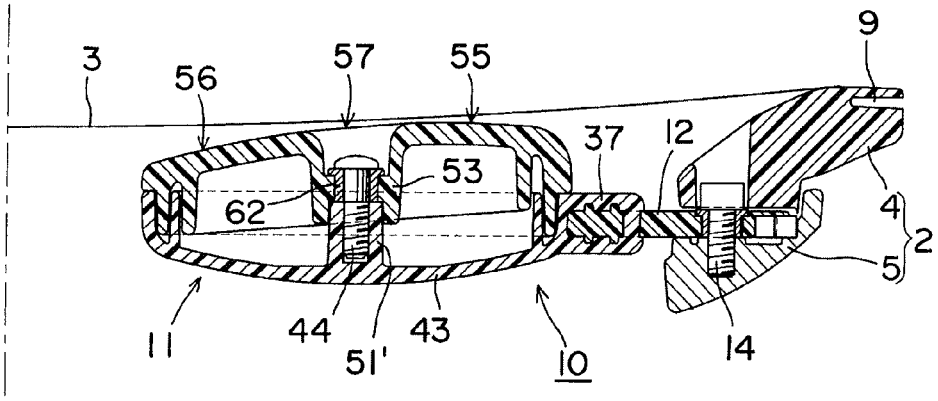
FIG. 37 is an explanatory diagram illustrating an example in which a primary abutment surface of the pad of the lumbar support member of the same embodiment is disposed on the back frame side of the backrest.

Here, on the surface of the lumbar support portion for supporting the body of the sitting person, i.e., the abutment surface 57 on the front side of the pad 42, a plurality of support regions, which can provide different abutment strengths for the body of the sitting person, are provided. The plurality of support regions are configured by, for example, a primary abutment surface 55 whose projecting amount toward the body of the sitting person is large so that the abutment against the body of the sitting person is relatively strong, and a secondary abutment surface 56 whose projecting amount is smaller than that of the primary abutment surface 55 so that the abutment against the body of the sitting person is relatively weak. The term of the primary abutment surface is used to mean a surface which is mainly abutted strongly, and the term of the secondary abutment surface is used to mean a surface which is not intended to be positively abutted, but is secondarily abutted. In this embodiment, the primary abutment surface 55 is configured by a plane surface, and the secondary abutment surface 56 is configured to have an inclined surface such that its projecting amount toward the body of the sitting person is gradually decreased, comparing to the primary abutment surface 55. Then, in this case, the secondary abutment surface 56 is preferably configured to include a flank having an inclination which is apart from the cover material or follows the same. Thus, according to the non-spherical abutment surface 57 configured by the primary abutment surface 55 and the secondary abutment surface 56, without providing the inclination θ to the lumbar support portion 11 with respect to the lumbar support stay portion 12 which is attached in a direction orthogonal to the rotation shaft 14 of the back frame 5 as illustrated in FIG. 5, for example, as illustrated in FIG. 37, by disposing the secondary abutment surface 56 on the central side of the backrest, and by disposing the primary abutment surface 55 on the rotation shaft 14 side, the abutment surface 57 is formed so as to have an angle which is easily followed along the shape of the cover material 3, thereby omitting the operation of angle adjustment. Moreover, even when the lumbar support member 10 is rotated about the rotation shaft 14, the lumbar support portion 11 is moved parallel with and along the opposing cover material 3 so that the distance between the cover material 3 and the lumbar support portion 11 is not changed. Accordingly, the force for supporting the lumbar vertebra portion of the sitting person is not fluctuated.

Moreover, between the base 43 and the pad 42, as a positioning means for specifying the direction of the pad 42, both of the shaft portion 51 and the hole 52 are configured to have a rectangular or polygonal symmetrical shape, so as to be fitted into and fixed with each other at the angle where the contours coincide with each other. One annular groove, e.g., the annular groove 46, is provided with a rib 50, and the annular protrusion 48 of the other member, which is fitted into the groove 46, is provided with a cutout 49 which is fitted into the rib 50. In this embodiment, the rib 50 is formed at the base 43, the cutout 49 is formed at the pad 42, and marks used for fitting them are formed at the outer circumferential surface of the pad 42 and the sheath portion 37 of the base 43. As the marks, a line 59 is carved on the pad side, and a sign of triangle 58 is carved on the base side. Therefore, when the annular grooves 45, 46 and the annular protrusions 47, 48 are fitted into each other by rotating the pad 42 such that the line 59 of the pad 42 corresponds to the triangle sign 58 of the base, the rib 50 and the cutout 49 correspond to each other so as to be fitted into each other, thereby fitting the base 43 and the pad 42 with each other in a non-rotatable manner. When the screw 44 is fastened under this state, the pad 42 and the base 43 are integrated with each other, so as to be attached to the back frame 2 via the lumbar support stay portion 12 under a state of being swingable about the rotation shaft 14. In this embodiment, the lumbar support portion 11 is configured by combining the two members of the pad 42 and the base 43 in order to make the same in a light weight and obtain desired elasticity and rigidity for the body abutment side and the side supporting the body abutment side. However, in some cases, the lumbar support portion 11 may be configured by an integrally molded shell structure or a solid structure.

The lumbar support stay portion 12 is formed by glass fiber reinforced plastic, for example, glass fiber reinforced nylon, and is insert-molded when the base 43 is injection-molded. Therefore, ribs 60 for prevention of coming out are doubly formed at the portion of the lumbar support stay portion 12 which is fitted into the base, and a hole 61 through which the resin of the base 43 passes is formed. This lumbar support stay portion 12 is rotatably attached to the back frame 2 by means of the hole 15 formed on its proximal end side with the screw as the rotation shaft 14.

Between the back frame 2 and the lumbar support member 10, a positioning mechanism is preferably disposed in order to prevent the lumbar support member 10 from sliding down due to its self-weight. The positioning mechanism is preferably configured such that the force for fixing the lumbar support member 10 to the back frame 2 is increased by frictional force or engagement by an elastic member, and is described in detail, for example, in the embodiment related to FIG. 4 and FIG. 5, so that the description is omitted here.

According to the thus constituted lumbar support apparatus, the lumbar vertebra portion of the sitting person is softly pressed and elastically supported mainly by the primary abutment surface 55 which is formed by the plane surface of the abutment surface 57 of the pad 42. For example, as illustrated in FIG. 37, the secondary abutment surface 56 is disposed on the central side of the backrest, and the primary abutment surface 55 is disposed on the rotation shaft 14 side. With this, there can be formed at the central side of the backrest the abutment surface 57 which follows the shape of the depressing cover material 3. Moreover, the lumbar vertebra portion of the sitting person is supported by the primary abutment surfaces 55 existing at the positions which are certainly apart from the center line C of the backrest to the left and right directions. Accordingly, even when the sitting manner of the sitting person is deviated from the center line C of the backrest, it is few that the back bone is directly pressed. The secondary abutment surface 56 formed by an inclined surface is disposed at the portion closer to the center of the backrest. Accordingly, even when the cover material 3 is deflected so as to expand backward, the inclined secondary abutment surface 56 exists along the cover material 3, so that there is no strong abutment against the back. On the other hand, adjacent to the region where the primary abutment surface 55 exists, the projecting amount toward the cover material 3, i.e., the projecting amount toward the backrest, is large, so that there is a strong abutment against the body.

Figure 36:
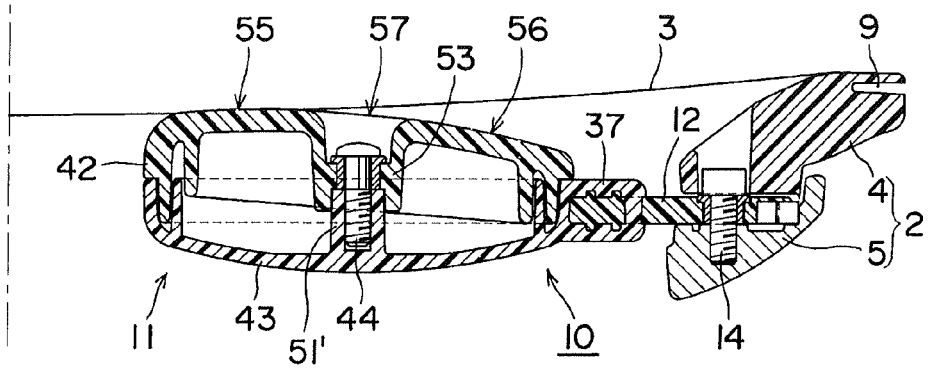
FIG. 36 is an explanatory diagram illustrating an example in which a primary abutment surface of the pad of the lumbar support member of the above embodiment is disposed on the center side of the backrest.

The above-mentioned embodiment is configured such that, by fitting the pad 42 into the base 43 only under a constant positional relationship, the primary abutment surface 55 and the secondary abutment surface 56 of the lumbar support portion 11 are attached to the back frame 5 under a predetermined positional relationship. Namely, as illustrated in FIG. 37, the secondary abutment surface 56, which is an inclined surface, is disposed on the region of the backrest closer to the center line, and the primary abutment surface 55, which is made by a plane surface, is disposed at the position apart from the center line of the backrest. With this, the lumbar portion of the sitting person is pressed at the positions certainly apart from the back bone. However, some users may prefer to be strongly pressed against the lumbar portion at the region closer to the center line of the backrest, i.e., the portion closer to the back bone, as illustrated in FIG. 36. Therefore, in some cases, it may be preferable that the position of the pad 42 is not completely fixed, and can be changed among predetermined optional angles or positions.

Moreover, in some cases, the abutment positions against the body by the plurality of support regions of the lumbar support portion 11 can be made changeable by disposing the lumbar support portion 11 to the lumbar support stay portion 12 so as to be rotatable about the rotation shaft which is disposed between the support regions. For example, in FIGS. 30 to 32, there is illustrated an example of the embodiment of the lumbar support portion in which the abutment positions of the plurality of support regions against the body are changed by rotating the lumbar support portion. The lumbar support portion 11 of this embodiment is configured by forming the pad 42 having the plurality of support regions and the base 43 supported by the lumbar support stay portion 12 in separable independent bodies, so that the assembling positions can be changed. By making the assembling position of the pad 42 to the base 43 changeable, a position preferred by the user can be strongly pressed by changing the position in the rotation directions of the primary abutment surface 55 in the lumbar support portion 11. Specifically, it is configured by omitting the cutout 49 and the rib 50 for positioning the pad 42 from the lumbar support portion of the embodiments illustrated in FIGS. 22 to 29. Namely, there is provided at the center between the base 43 structured in a shell and the pad 42 a boss portion 53 having a shaft portion 51 and a hole 52 whose shapes of the transverse sectional contours are rectangular, so that the pad 42 can be fixed while being rotated by every 90 degrees. Of course, the shapes of the sectional contours of the shaft portion 51 and the hole 52 of the boss portion 53 are not limited to rectangular, and can be triangular, pentagonal, or hexagonal, or more, so that the adjustable degree of angle for positioning is determined according to its number of angles.

In the lumbar support member 10 of this embodiment, when the pad 42 is attached to the base 43, the positional relationship between the primary abutment surface 55 and the secondary abutment surface 56 of the lumbar support portion 11 is determined. Namely, when the shaft portion 51 and the hole 52 of the boss portion 53, which are polygonal, are fitted into each other, after positioning the primary abutment surface 55 of the pad 42 at a preferable angle or position (the height direction or width direction of the backrest) by rotating the same, the fitting is performed at the corresponding surface of the shaft portion adjacent to the same, and the screw is fastened under this state. With this, the lumbar support member 10 is attached to the back frame 2 at the selected angle or position. Moreover, some users want to subtly change the position of the lumbar support member 10 even during sitting on the chair. Even in such a case, if the rotation of the lumbar support member 10 about the rotation shaft 14 is not sufficient for addressing this situation, once the pad 42 is removed from the base 43, and is assembled after changing the position and angle of the primary abutment surface 55 at optional ones, so that the position of the primary abutment surface can be changed to the preferred position. Then, the lumbar vertebra portion of the sitting person is softly pressed and elastically supported mainly by the primary abutment surface 55 of the surface of the non-spherical pad 42, i.e., abutment surface 57. Moreover, by changing the direction of the abutment surface corresponding to the degree of curvature of the back of the sitting person, the supporting area is increased so that the lumbar portion can be supported by using an entire pad.

Note that, although not shown in the drawings, if there are prepared several kinds of pads 42 provided with on their surfaces the abutment surfaces 57 having different shapes or rigidities, any pad of an optional shape or rigidity can be selected and assembled according to the preference of the user. Thus, when the plurality of support regions, which can provide different abutment strengths for the body of the sitting person, can be changed by replacing the pad 42, the lumbar support apparatus according to the preference of the user can be provided.

Figure 30:
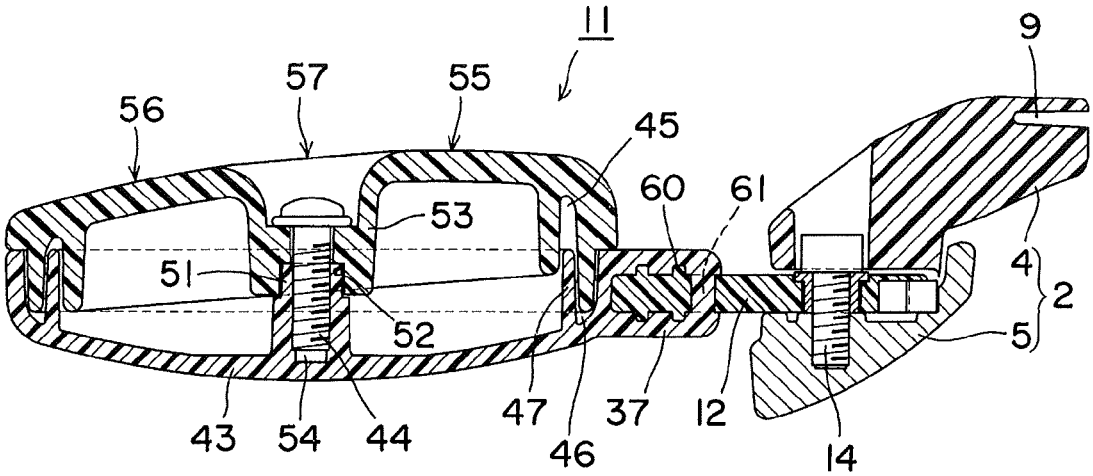
FIG. 30 is a central and vertical sectional view illustrating a twelfth embodiment of a lumbar support apparatus of the present invention.
Figure 31:
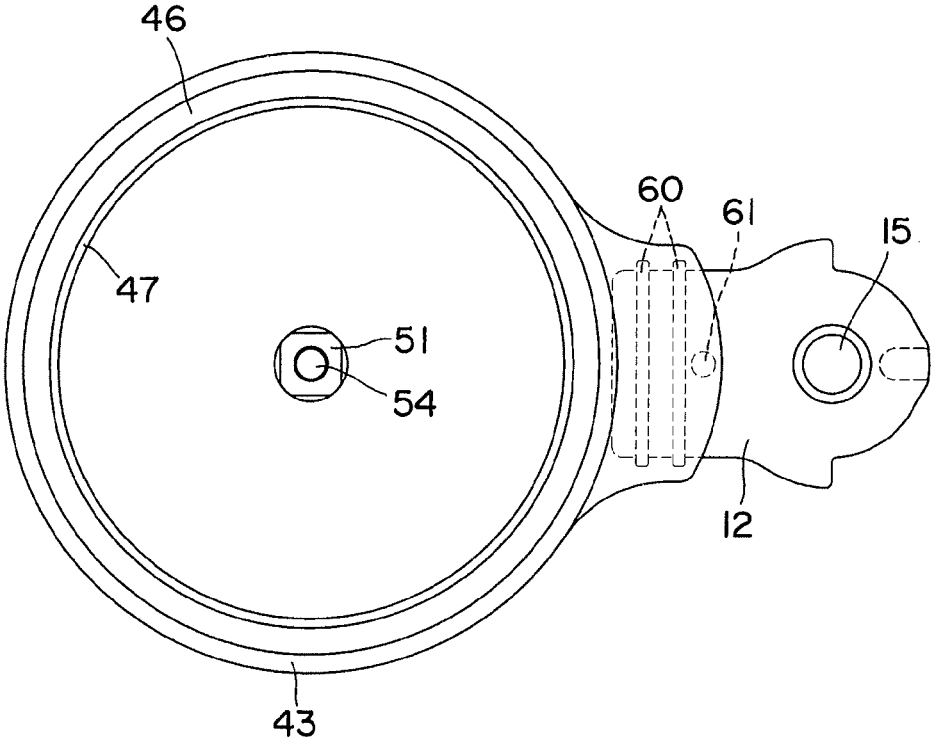
FIG. 31 is a front view illustrating only a base by disassembling the above lumbar support portion.
Figure 32:
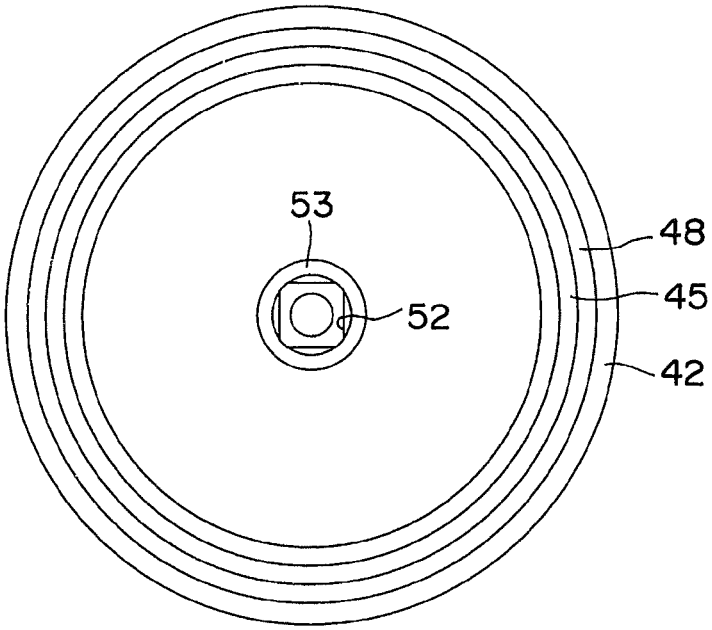
FIG. 32 is a back view illustrating only a pad of the above lumbar support portion.

In the embodiment illustrated in FIGS. 30 to 32, both the shaft portion 51 and the hole 52 are configured in a rectangular or polygonal symmetrical shape, so as to be fitted into and fixed to each other at the angle where the contours correspond to each other. However, in some cases, the transverse sectional contour shape of one of the shaft portion 51 and the hole 52 may be provided with a circular or partially circular contour surface. With this, the structure which can provide such a frictional force that, when an external force is intentionally applied to the pad 42 so as to be rotated, the pad 42 is allowed to be rotated, and the pad 42 is not allowed to be rotated when an external force, which is weaker than the intentionally applied rotational force, or a rotation moment due to an eccentricity of the center of gravity, is applied. In this case, when releasing the pad 42 at an optional position during its rotation, the pad 42 is fixed at the position. This constitution is preferable for the users who want to subtly change the position even during sitting on the chair.

Figure 33:
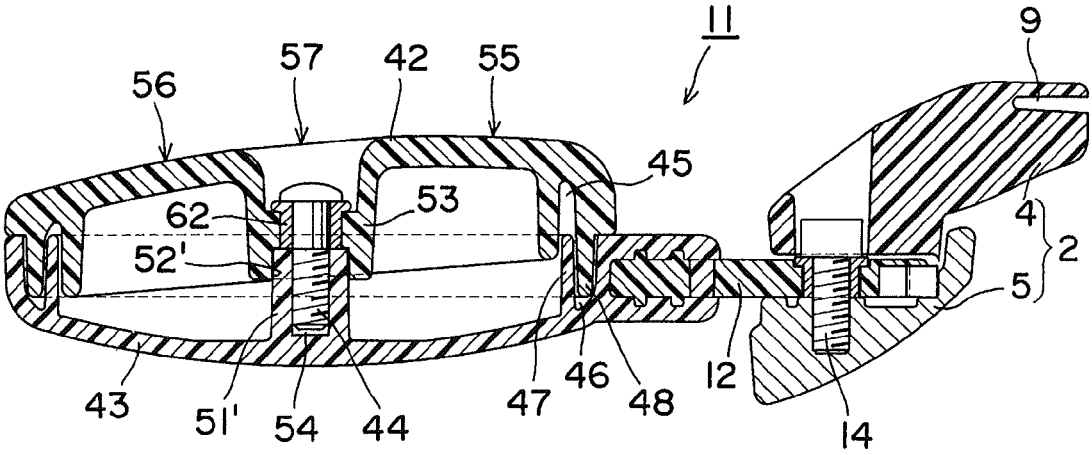
FIG. 33 is a central and vertical sectional view of a thirteenth embodiment of a lumbar support apparatus of the present embodiment.
Figure 34:
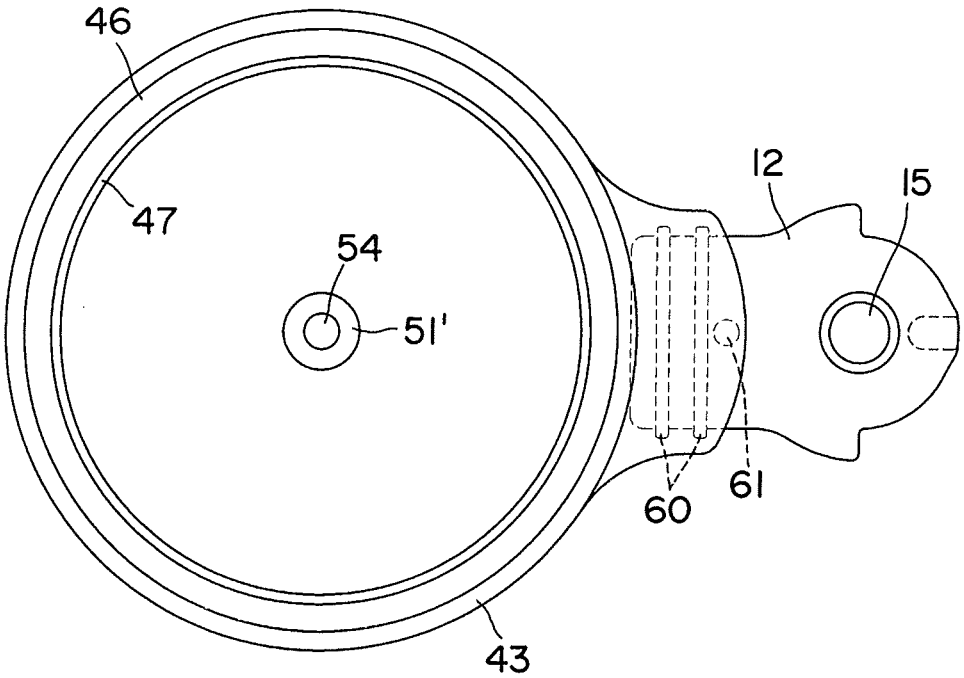
FIG. 34 is a front view illustrating only a base by disassembling the above lumbar support portion.
Figure 35:
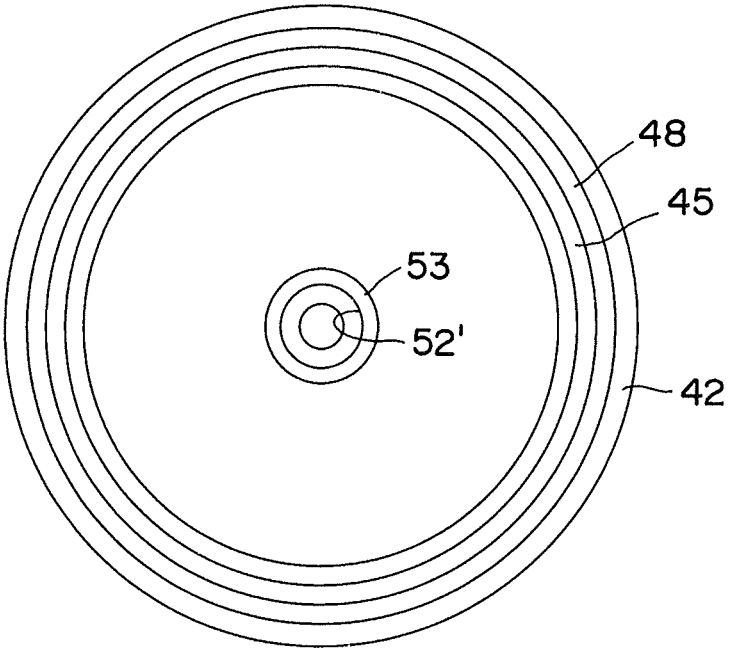
FIG. 35 is a back view illustrating only a pad of the above lumbar support portion.

Moreover, in the embodiment illustrated in FIGS. 30 to 32, the shapes of the shaft portion 51 and the hole 52 may be made circular so as to make the pad 42 freely rotatable, thereby making the position of the primary abutment surface 55 changeable by the rotation of the pad 42. For example, as illustrated in FIGS. 33 to 35, the base 43 and the pad 42 include at their circumferential edge portions annular grooves 45, 46 and annular protrusions 47, 48 which are fitted into each other. There are respectively provided a circular shaft portion 51' including at its central portion a threaded screw hole 54 into which the screw 44 for connection is screwed, and a boss portion 53 including a circular hole 52' into which the shaft portion 51' is fitted. Then, the base 43 and the pad 42 are connected with each other by screwing the screw 44 to the threaded screw hole 54 of the shaft portion 51' under the state in which the shaft portion 51' and the hole 52' of the boss portion 53 are fitted into each other. Here, in order to make the rotation of the pad 42 smooth, the pad 42 is preferably fixed to the base 43 via a brimmed collar 62. In this case, the screw 44 is screwed to the shaft portion 51' under a state in which the end face of the shaft portion 51' and the brimmed collar 62 are abutted to each other. Accordingly, although the brimmed collar 62 is fixed to the shaft portion 51' on the base 43 side, the boss portion 53 of the pad 42 is not fastened so as to be rotatably held. Therefore, the pad 42 can be freely rotated 360 degrees around the brimmed collar 62. Moreover, the fastening force to the boss portion 53 between the brim of the brimmed collar 62 and the end face of the shaft portion 51' can be adjusted by adjusting the length of the brimmed collar 62, so that a friction of an optional magnitude can be applied to the boss portion 53. With this, it can be configured such that the pad 42 can be fixed by frictional force at the position where the rotated pad 42 is released. The pad 42 may be fixed at any position by using the friction between the shaft portion 51' and the hole 52' whose sections are circular. Note that, when being freely rotated within the range of 360 degrees like this embodiment, the annular grooves 45, 46 and the annular protrusions 47, 48 of the base 43 and the pad 42 are preferably formed in perfect circles, or substantially perfect circles. However, when being freely rotated within a limited range of angle, this is not the only case.

Also in this embodiment, at the abutment surface 57 on the front side of the pad 42, there are formed the plurality of support regions configured by the primary abutment surface 55 which is abutted against the body of the sitting person relatively strongly because the projecting amount thereof toward the body of the sitting person is large, and the secondary abutment surface 56 which is abutted against the body of the sitting person relatively weakly because the projecting amount thereof is smaller than that of the primary abutment surface 55. Then, in the lumbar support portion 11, the positional relationship between the primary abutment surface 55 and the secondary abutment surface 56 of the lumbar support portion 11 can be freely changed to any position only by rotating the pad 42. For example, as illustrated in FIG. 37, the secondary abutment surface 56, which is an inclined surface, is disposed on the region of the backrest closer to the center line, and the primary abutment surface 55 is disposed at the position apart from the center line of the backrest. With this, the lumbar support portion 11 can be used such that the lumbar portion of the sitting person is pressed at the positions certainly apart from the back bone. Moreover, by rotating 180 degrees from the position illustrated in FIG. 37, as illustrated in FIG. 36, the primary abutment surface 55 is disposed at the position closer to the center line of the backrest, and the secondary abutment surface 56, which is an inclined surface, is disposed at the position apart from the center line of the backrest. With this, the lumbar support portion 11 can be used such that the lumbar portion of the sitting person is pressed stronger at the position closer to the center line of the backrest, i.e., the portion closer to the back bone. Of course, the pad 42 can be used by stopping its rotation at any position between the position of FIG. 36 and the position of FIG. 37. In any case, the lumbar vertebra portion of the sitting person is softly pressed and elastically supported by mainly the primary abutment surface 55 of the pad 42.

As illustrated in FIGS. 38 to 41, the lumbar support portion 11 may be configured to be rotatable so that, with respect to the cover material 3, the abutment surface on the front side of the lumbar support portion 11 (support region) and the abutment surface on the rear side (support region) can be changed between the front side and the rear side, by using a rotation shaft disposed on a plane orthogonal to the rotation shaft 14 of the back frame 5, e.g., a vertical rotation shaft disposed in the upward and downward directions of the backrest, or a transverse rotation shaft disposed in the width directions of the backrest, or a rotation shaft obliquely disposed between them. In this case, with respect to the rotation shaft 70 as the center, both of the front side of the body side surface of the sitting person of the lumbar support portion 11, and the rear side of its opposite side surface constitute the abutment surfaces 57. By switching the rear side abutment surface 57 and the front side abutment surface 57 by the rotation about the rotation shaft 70, the abutment strength of the lumbar support portion against the body or the position where the abutment against the body is strong can be adjusted. Note that, in respective embodiments of FIGS. 38 to 41, the screw 44 functions only as a means for merely connecting the pad 42 and the base 43, and does not function as a rotation shaft for switching the support regions.

Figure 38:
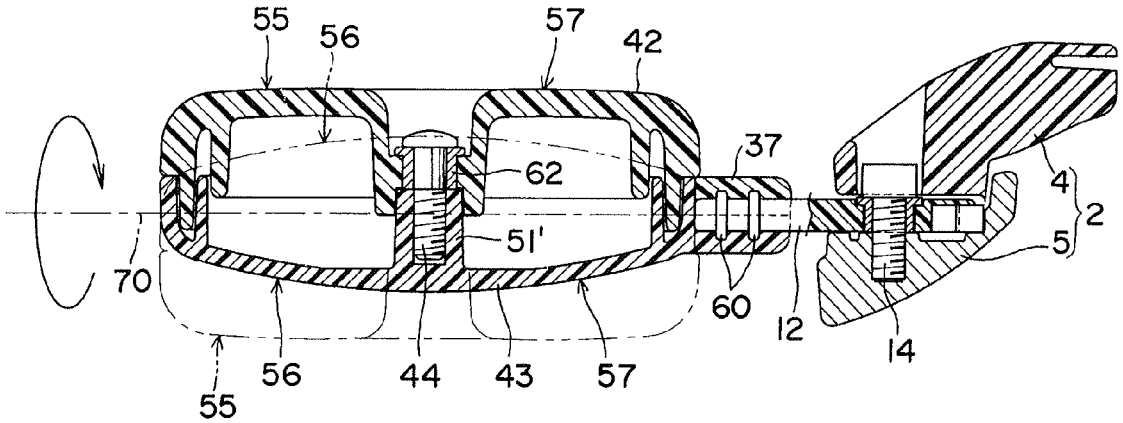
FIG. 38 is a central and vertical sectional view illustrating a fourteenth embodiment of a lumbar support apparatus of the present invention.
Figure 39:
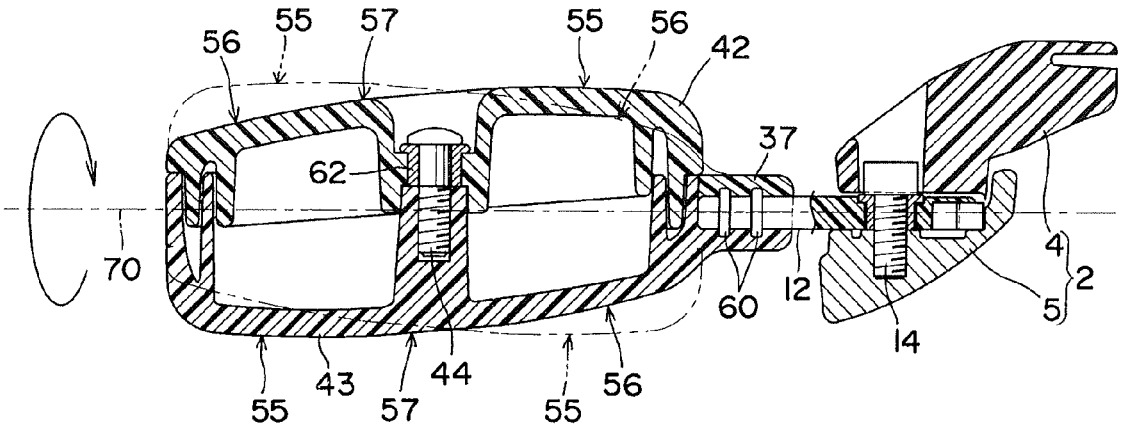
FIG. 39 is a central and vertical sectional view of a fifteenth embodiment of a lumbar support apparatus of the present invention.
Figure 40:
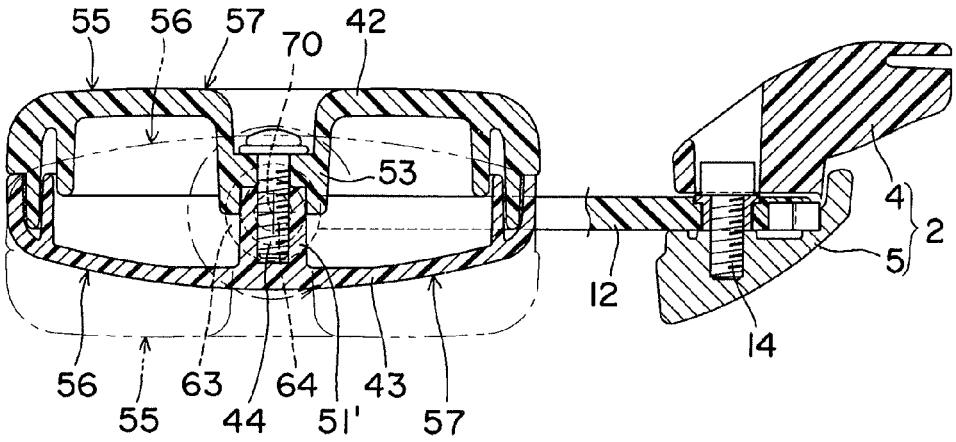
FIG. 40 is a central and vertical sectional view of a sixteenth embodiment of the lumbar support apparatus of the present invention.

In the embodiment of a transverse rotation shaft illustrated in FIG. 38 and FIG. 39, for example, the lumbar support stay portion 12, which is rotatably supported on the back frame 5 is used as a rotation shaft 70. In the case of this embodiment, at least the portion of the lumbar support stay portion 12 which is fitted into the sheath portion 37 of the base 43 is formed as a shaft having a circular section, and the lumbar support portion 11 including the sheath portion 37, the base 43, and the pad 42 integrated with the base 43, is rotatably supported. A flange 60 functioning as a retainer is also formed in a circular shape. The sheath portion 37 is molded to two halves, and the two halves are fitted into each other and fastened so as to sandwich the flange 60 and the shaft portion of the distal end having a circular section of the lumbar support stay portion 12, thereby rotatably connecting the sheath portion 37 of the base 43 and the lumbar support stay portion 12 with each other. In the embodiment of a vertical rotation shaft illustrated in FIG. 40 and FIG. 41, for example, the rotation shaft 70 is configured by using a screw or pin in the vertical direction which rotatably connects with each other a part of the circumferential edge of the lumbar support portion 11 integrated into the drum-shaped shell structure by combining the pad 42 and the base 43 so as to be connected by the screw 44 with each other, and the lumbar support stay portion 12 rotatably supported on the back frame 5. In the case of this embodiment, adjacent to the shaft portion which is the rotation center, it is formed by glass fiber reinforced plastic, e.g., glass fiber reinforced nylon, and is insert-molded when the base 43 is injection-molded. Of course, the mode of the rotation shaft 70 and the lumbar support portion 11 supported by the rotation shaft 70 is not limited to that illustrated in the drawings.

Figure 41:
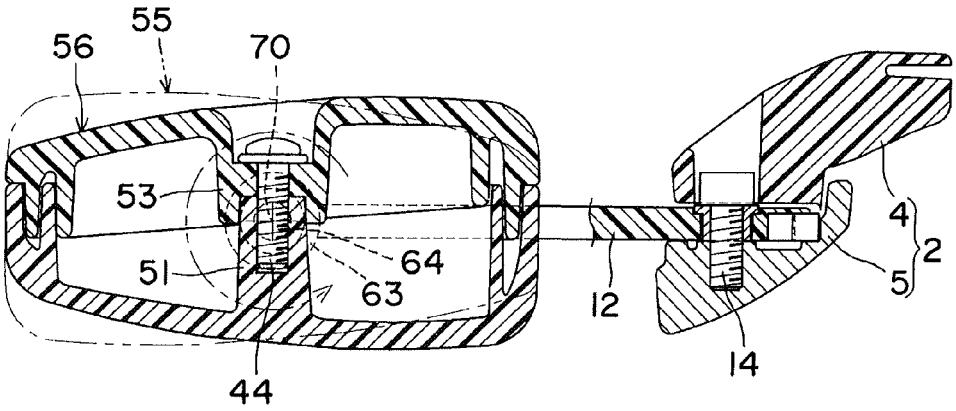
FIG. 41 is a central and vertical sectional view illustrating a seventeenth embodiment of a lumbar support apparatus of the present invention.

Here, for convenience of explanation, the lumbar support portion 11 is exemplified by those illustrated in FIGS. 22 to 37 in which the drum-shaped shell structure is constituted by combining the pad 42 and the base 43 mentioned above. However, it is needless to say that this structure is not the only case. The lumbar support portion 11 of this embodiment is configured such that the front side of the body side surface of the sitting person and the rear side of its opposite side surface of the lumbar support portion 11 can be changed with each other by rotating the lumbar support portion 11 about the rotation shaft 70, so that the abutting strength or the position where the abutment against the body is strong can be adjusted. Therefore, the shapes of the abutment surfaces 57 are made different between the front side of the body side surface of the sitting person and the rear side of its opposite side surface of the lumbar support portion 11, and the projecting amounts toward the backrest or the rigidities thereof are made different from each other. For example, in the embodiment of FIG. 38 and FIG. 40, the abutment surface 57 on the base 43 side is formed in a spherical shape which is low and gently-sloping so as to have a small projecting amount, and the abutment surface 57 on the pad 42 side is formed in a even planer shape so as to have a large projecting amount, so that the abutment strength can be switched by the rotation of the lumbar support portion 11. In the embodiment of FIG. 39 and FIG. 41, both of the abutment surfaces 57 on the base 43 side and the pad 42 side include the secondary abutment surfaces 56 formed by inclined surfaces and the primary abutment surfaces 55 formed by plane surfaces, and are configured such that the positional relationships are opposite to each other between the front side and the rear side. Therefore, by the rotation of the lumbar support portion 11, the strong abutment positions are changed between the position on the central side of the backrest in the width directions of the backrest and the position closer to the back frame 5 side apart from the center. Note that, in the case of this embodiment, because both of the pad 42 on the front side and the base 43 on the rear side of the lumbar support portion 11 support the body, it is desirable that the pad 42 and the base 43 are molded by synthetic resin, such as polyurethane elastomer, whose rigidity has been adjusted so as to provide an appropriate elasticity when being applied to the body.

Figure 42:
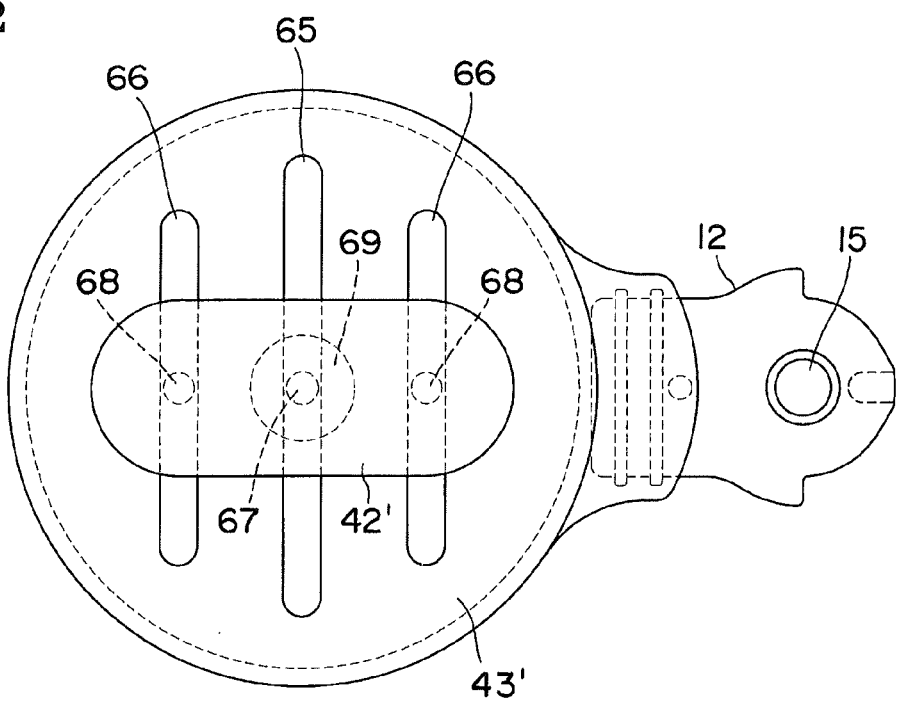
FIG. 42 is a front view illustrating an eighteenth embodiment of a lumbar support apparatus of the present invention.
Figure 43:
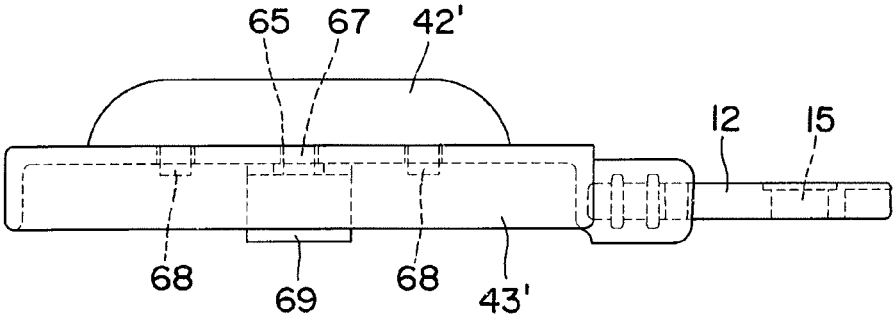
FIG. 43 is a bottom view of a lumbar support portion of the eighteenth embodiment.

The structure for changing the abutment position against the body of the lumbar support portion 11 is not limited to that in which the front side of the body side surface of the sitting person and the rear side of its opposite side surface are exchanged by the rotation of the lumbar support portion 11 itself. For example, as illustrated in FIG. 42 and FIG. 43, the pad 42' for supporting the body of the sitting person may be configured to be linearly movable along the surface of the base 43' supported by the lumbar support stay portion 12, thereby changing the abutment position and the abutment amount (feeling to be abutted) for the sitting person. In this embodiment, the plate-shaped pad 42' is slidable along the grooves which transverse the plane base 43'. Specifically, a fixing groove 65 passing the center of the base 43' and two guiding grooves 66 disposed parallel to the fixing groove 65 at its left and right sides are formed so as to be vertically arranged. The pad 42' is disposed so as to move along these three grooves 65, 66. The pad 42' includes guide pins 68 passing through the left and right guiding grooves 66, and a fixing screw 67 passing through the central fixing groove 65. A knob 69 is screwed to the fixing screw 67 passing through the fixing groove 65 so that the pad 42' is fixed at any position. The pad 42' in this embodiment is formed in an elliptical pillow shape having a raised central portion, but this is not the only shape, and a spherical shape can be used. In the case of the spherical pad, it is needless to say that to dispose a single fixing groove functioning also as a guiding groove is sufficient. Here, the grooves 65, 66 on the base 43' are formed as vertical grooves, but this is not the only case, and the grooves can be formed in a transverse or inclined direction in which the pad 42' are linearly movable. With this, together with the movement of the pad 42' on the base 43', the entire lumbar support member 10 is swung about the rotation shaft 14, so that position of the pad 42', i.e., the abutment position of the lumbar support portion 11 against the sitting person, can be freely set. Note that, although not shown, in order to improve the appearance, it is preferable that the entire base 43' together with the pad 42' is covered by a cover, and only a fixing means for moving and fixing the pad 42', such as the knob 69 or a lever, is disposed so as to be exposed on the rear side.

Note that, in the lumbar support apparatuses of the embodiments illustrated in FIGS. 23 to 44, there are mentioned the examples of the lumbar support portions using the pads which have a circular shape when viewed mainly from the front of the chair, but this is not the only shape. For example, when the pad 42 and the base 43 are integrated so as to forma support structure which is rotatable with respect to the lumbar support stay portion 12, the lumbar support portion 11 can be formed to have a shape, such as an ellipse or a rectangle which has alongside and a short side. In this case, the surface for supporting the body of the sitting person can be set within the long range in any direction, so that the user's preference which requires a support over a longer range can be addressed, and the support position can be largely changed. The shape of the lumbar support portion 11 viewed from the front (forward side) can be made in a square or other polygonal shapes. In this case, when rotating only the pad 42, the support of the base 43 is not lost, so that the pad 42 can be rotated by a given angle.

Moreover, in the lumbar support apparatuses of the embodiments illustrated in FIGS. 23 to 44 which are provided with the lumbar support portions including the surfaces supporting the body of the sitting person made by a plurality of support regions for providing different abutment strengths, by disposing a positioning mechanism exemplified in FIG. 4 and FIG. 5 between the back frame 5 and the lumbar support member 10, e.g., between the lumbar support stay portion 12 and the back frame 5, or between the sheath portion 37 of the base 43 and the lumbar support stay portion 12, an appropriate resistance can be applied to the expansion and contraction movements between the lumbar support portion 11 and the lumbar support stay portion 12, or the rotation of the lumbar support stay portion 12. As exemplified in FIGS. 8 to 11, by attaching the lumbar support stay portion 12 to the brackets 22, 24 projecting from the back frame 5 via the rotation shaft 14, the adjustment range of the supporting rigidity or the adjustment ranges of the rotation radius, the height position, and the like, of the lumbar support portion 11, can be made more flexible. The left and right lumbar support members 10 are not limited to the case in which the rotation is made about the rotation shaft 14 in the upward and downward directions. As exemplified in FIG. 12 and FIG. 13, by attaching the left and right lumbar support members 10 so as to be swingable only in either upward or downward direction with respect to the line segment passing through the left and right rotation shafts 14, the left and right lumbar support members 10 are disposed such that they are brought into the closest position in a row at one rotation end of the left and right lumbar support member 10. With this, even at the narrowest portion, there can be generated a space larger than the width of the back bone. As exemplified in FIGS. 14 to 19, by constituting the left and right lumbar support members 10 as linkable structures, when one lumbar support member 10 is rotated, the other lumbar support member 10 can be reversely rotated. For example, as exemplified in FIG. 14 and FIG. 15, the left and right lumbar support members 10 may be provided at their adjacent surfaces on the circumferential surface of the base with the gears 25, 26. As exemplified in FIG. 16 and FIG. 17, the left and right lumbar support members 10 may be linked by the oblong hole 29 and the connection pin 30, and the like. As exemplified in FIGS. 18 and 19, the left and right lumbar support members 10 may be linked by disposing the link 34 on the rear side of the base.

Figure 44:
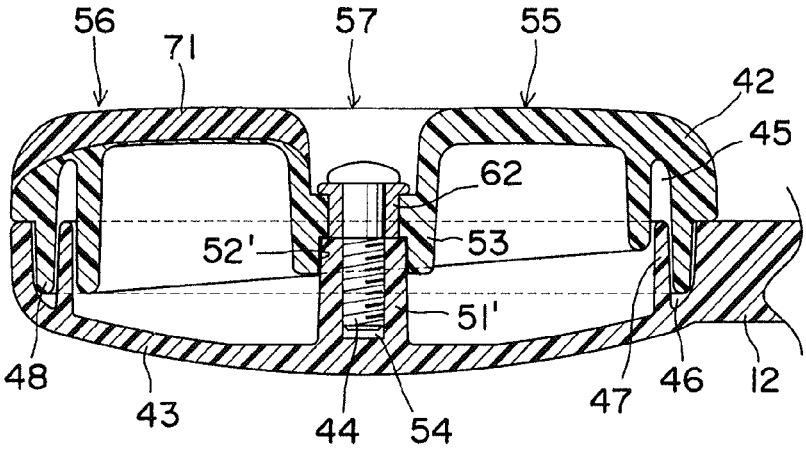
FIG. 44 is a central and vertical sectional view of a nineteenth embodiment of a lumbar support apparatus of the present invention.

In the above-mentioned embodiment, the abutment strength of the lumbar support portion 11, i.e., the relative projecting amount of the lumbar support portion 11 toward the back of the sitting person, depends on the forward projecting amount of the lumbar support portion 11, and the change of the abutment strength can be realized by changing the forward projecting mount of the lumbar support portion 11, but this is not the only case. The abutment strength, i.e., the feeling to be abutted, can be changed by providing variations of rigidity of the abutment surface 57 of the lumbar support portion 11, i.e., local differences in the softness of the abutment surface 57. For example, as illustrated in FIG. 44, a part of the abutment surface 57 of the pad 42 may be formed by a two color molding, and the like, so as to form a layer 71 having a different rigidity, e.g., a layer having elasticity larger than that of the portion constituting the primary abutment surface 55, or a soft and easily collapsible layer. With this, even when the wall thickness or the projecting amount of the pad 42 is the same, the abutment strength can be changed. In this case, not only the mere change of the abutment strength, the feeling of being abutted can also be changed by changing the rigidity of the material. As a method for locally changing the rigidity of the abutment surface 57 of the pad, although not shown, for example, the wall thickness may be locally thickened, or a reinforcement rib is disposed to the inside of the portion to be made more rigid.

Moreover, by increasing or decreasing the supporting area, i.e., the area of the abutment surface 57, the abutment strength of the lumbar support member or the stableness of supporting may be changed.

Note that, the above-mentioned embodiment is an example of preferred embodiments of the present invention, and is not the only case, so that various modifications can be applied thereto as long as it is not beyond the scope of the present invention. For example, the shape of the lumbar support portion 11 has been described mainly as a circular or ellipse mode in order to avoid interference between the adjacent edges, but this is not the only case. Any mode which provides an elastic support as a cantilever can be adopted. Any shape of the lumbar support portion 11 can provide a support which is more elastic than a both end support, so that, even when the back bone is abutted against the lumbar support portion 11, the soft abutment thereof causes few pain. Additionally, when being symmetrically disposed about the vertical plane with a constant space from the center C of the backrest 1, there is generated at the backrest center C a portion where no lumbar support portion 11 exists. Accordingly, when leaning on the center of the backrest, the lumbar portion is supported by the lumbar supports at the positions apart from the back bone, even a rather thin person does not feel pain because the plates of the lumbar supports are not directly abutted against the back bone.

When the lumbar support members 10, which are symmetrical about the vertical plane, are adopted, the same parts can be used, thereby decreasing the manufacturing cost. However, the present invention can be embodied, even when the left and right lumbar support members 10 are not symmetrical. For example, even when one lumbar support portion 11 has a larger area or width than that of the other lumbar support portion 11, or one lumbar support member 10 has a length crossing the back bone, and the other lumbar support member 10 has a length not reaching the back bone, the similar advantageous effects can be obtained.

Moreover, in this embodiment, there has been mainly described the example adopting the structure of fixing the cover material forming the backrest surface by stretching the cover material 3 and attaching the same to the groove 9 which is formed at the circumferential edge of the annular cover material support frame 4 made of resin. However, this is not the only case, and, needless to say, the lumbar support apparatus of the present invention can be applied to a chair adopting a cover material fixing structure for non-annular frame including two parallel side frames made of metal between which the cover material is stretched so as to form the backrest surface.

In this embodiment, there has been mainly described the example in which the lumbar support member 10 is disposed behind the extendable cover material 3, and the lumbar support apparatus is exposed on the rear side of the backrest. However, when a backrest having a greater rigidity than that of the cover material 3, for example, a non-flexible material, such as a metal or synthetic resin substrate, in which multiple holes are formed so as to pass through the same in the forth and back directions, is adopted, the lumbar support member may be exposed on the front surface of the substrate-shaped backrest, or the lumbar support member may be disposed between the substrate-shaped backrest and a cushion which is covered on the front surface of the substrate-shaped backrest. Therefore, the term "a projecting amount toward the body of the sitting person" used in this specification means the amount of projection toward the front side of the chair, regardless of the existence or non-existence of the sitting person on both the rear and front sides of the backrest.

In the embodiments illustrated in FIGS. 22 to 44, there has been mainly described the example in which the primary abutment surface 55 is configured by a plane surface and the secondary abutment surface 56 is configured by an inclined surface. However, the primary abutment surface 55 and the secondary abutment surface 56 are not limited to the plane surface and the inclined surface, and, needless to say, various shapes or modes can be adopted.

REFERENCE SIGNS LIST

1: backrest
2: back frame
3: cover material
4: cover material support frame
5: back support member
10: lumbar support member
11: lumbar support portion
12: lumbar support stay portion
14: rotation shaft
16: spring member constituting a positioning mechanism
17: uneven portion constituting a positioning mechanism
20: boundary between a lumbar support stay portion and an inclined lumbar support portion
25: gear
26: arc surface
29: oblong hole
30: pin passing through an oblong hole
34: connection link
37: sheath portion
39: O-ring constituting a positioning mechanism
42, 42': pad
43, 43': base
44: screw as a rotation center of the pad
51: shaft portion
52: hole
53: boss portion
55: primary abutment surface
56: secondary abutment surface (flank)
57: abutment surface

The invention claimed is:

1. A lumbar support apparatus of a chair for supporting a lumbar vertebra portion of a sitting person, the lumbar support apparatus being disposed at a portion of a backrest corresponding to the lumbar vertebra portion, the backrest being configured by a cover material, and a back frame including left and right vertical sides which support at least two opposing side edges of the cover material forming a backrest surface, wherein the lumbar support apparatus is configured by two lumbar support members which are separated into left and right parts, each of the lumbar support members including a lumbar support portion supporting the lumbar vertebra portion, a stay portion supporting the lumbar support portion, and a rotation shaft which is disposed in forth and back directions of the backrest, wherein an end portion of the lumbar support stay portion is rotatably connected to the left and right vertical sides of the back frame via the rotation shaft, the lumbar support members are attached so as to project from the left and right vertical sides of the back from to an inner side, so that a position of the lumbar support portion can be adjusted by moving the lumbar support portion such that a distal end side of the lumbar support portion is moved in a circular manner about the rotation shaft, and the left and right lumbar support members are independently deflected in a backward direction of the chair, and having a non-linkage relationship.

2. The lumbar support apparatus of the chair according to claim 1, wherein the lumbar support portion and the lumbar support stay portion are configured by separate members, and are connected with each other by being fitted into a sheath portion which is disposed at one of the lumbar support portion and the lumbar support stay portion.

3. The lumbar support apparatus of the chair according to claim 1, wherein a positioning mechanism is disposed between the back frame and the lumbar support member.

4. The lumbar support apparatus of the chair according to claim 3, wherein the positioning mechanism includes an uneven portion which is formed on one of the lumbar support stay portion and the back frame, and the other thereof is provided with an elastic member which is fitted into the uneven portion, so that an appropriate resistance is applied to an rotation of the lumbar support stay portion.

5. The lumbar support apparatus of the chair according to claim 1, wherein at least opposing faces with each other of the lumbar support portions disposed on left and right sides form arc surfaces or ellipsoids.

6. The lumbar support apparatus of the chair according to claim 1, wherein the lumbar support portion is provided with a convex portion which projects toward a front side.

7. The lumbar support apparatus of the chair according to claim 1, wherein the lumbar support stay portion is disposed in a direction orthogonal to the rotation shaft which is disposed in the forth and back directions of the backrest with respect to the back frame, and the lumbar support portion is disposed so as to be inclined with respect to the lumbar support stay portion, and is disposed parallel to a portion of the cover material opposite to the lumbar support portion.

8. The lumbar support apparatus of the chair according to claim 1, wherein a face of the lumbar support portion supporting a body of the sitting person includes a plurality of support regions by which different abutment strengths for the body of the sitting person can be obtained.

9. The lumbar support apparatus of the chair according to claim 8, wherein the plurality of support regions forms a primary abutment surface which is abutted against the body of the sitting person relatively strongly because a projecting amount thereof toward the body of the sitting person is large, and a secondary abutment surface which is abutted against the body of the sitting person relatively weakly because a projecting amount thereof is smaller than that of the primary abutment surface.

10. The lumbar support apparatus of the chair according to claim 9, wherein the secondary abutment surface is a flank including an inclination which is apart from the cover material or follows the cover material.

11. The lumbar support apparatus of the chair according to claim 8, wherein the lumbar support portion is configured by a pad which has the plurality of support regions and a base which is formed as a separate body separable from the pad so as to support the pad and be supported by the lumbar support stay portion, the plurality of support regions, by which different abutment strengths against the body of the sitting person can be obtained, are configured such that the plurality of support regions can be changed into various modes, by making the pad replaceable.

12. The lumbar support apparatus of the chair according to claim 8, wherein the lumbar support portion is configured such that a rotation shaft, on which the lumbar support portion is disposed so as to be rotatable with respect to the lumbar support stay portion, is disposed between the plurality of support regions, so that positions where the plurality of support regions are abutted against the body can be changed by a rotation of the lumbar support portion about the rotation shaft between the plurality of support regions.

13. The lumbar support apparatus of the chair according to claim 12, wherein the rotation shaft between the plurality of support regions is disposed in the forth and back directions of the backrest, so that a position of the plurality of support regions can be changed by the rotation of the lumbar support portion.

14. The lumbar support apparatus of the chair according to claim 13, wherein the lumbar support portion is configured by a pad which includes the plurality of support regions and a base which is formed by a separate body separable from the pad so as to support the pad and is supported by the lumbar support stay portion, the pad is made rotatable by using a connection shaft, which connects the pad with the base at their centers, as the rotation shaft which is disposed between the plurality of support regions in the forth and back directions of the backrest, so that the position of the plurality of support regions can be changed by a rotation of the pad.

* * * * *